US010615509B2

(12) United States Patent
Toyao

(10) Patent No.: US 10,615,509 B2
(45) Date of Patent: Apr. 7, 2020

(54) ANTENNA AND WIRELESS COMMUNICATION DEVICE

(71) Applicant: NEC CORPORATION, Tokyo (JP)

(72) Inventor: Hiroshi Toyao, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 82 days.

(21) Appl. No.: 15/558,421

(22) PCT Filed: Mar. 18, 2016

(86) PCT No.: PCT/JP2016/058684
§ 371 (c)(1),
(2) Date: Sep. 14, 2017

(87) PCT Pub. No.: WO2016/148274
PCT Pub. Date: Sep. 22, 2016

(65) Prior Publication Data

US 2018/0062271 A1 Mar. 1, 2018

(30) Foreign Application Priority Data

Mar. 19, 2015 (JP) ..... 2015-055831

(51) Int. Cl.
*H01Q 21/00* (2006.01)
*H01Q 19/10* (2006.01)
(Continued)

(52) U.S. Cl.
CPC ..... *H01Q 19/10* (2013.01); *H01Q 1/38* (2013.01); *H01Q 9/0464* (2013.01);
(Continued)

(58) Field of Classification Search
CPC ..... H01Q 19/32; H01Q 1/38; H01Q 21/06; H01Q 3/18; H01Q 1/40; H01Q 3/26
(Continued)

(56) References Cited

U.S. PATENT DOCUMENTS 6,262,495 B1 7/2001 Yablonovitch et al.
6,970,137 B1 * 11/2005 Maslovski ..... H01Q 1/243 343/700 MS
(Continued)

FOREIGN PATENT DOCUMENTS

JP 2006-222873 A 8/2006
JP 2008-182338 A 8/2008
(Continued)

OTHER PUBLICATIONS

International Search Report for PCT/JP2016/058684, dated May 24, 2016.

*Primary Examiner* — Dameon E Levi
*Assistant Examiner* — Collin Dawkins
(74) *Attorney, Agent, or Firm* — Sughrue Mion, PLLC

(57) ABSTRACT

A small-size antenna for wireless communication includes a conductive reflector, a dielectric substrate disposed on the conductive reflector, a radiation module that is disposed on the main surface of the dielectric substrate so as to emit radio waves, a power supply configured to supply power to the radiation module disposed on the main surface of the dielectric substrate, and a plurality of split-ring resonators that are disposed in an area between the radiation module and the conductive reflector on the main surface of the dielectric substrate. The conductive reflector reflects radio waves emitted by the radiation module towards the conductive reflector. Each of the split-ring resonators includes a split having first and second ends disposed oppositely and separated from each other, and a ring connected between the first and second ends.

2 Claims, 18 Drawing Sheets

(51) Int. Cl.

| | |
|---|---|
| ***H01Q 1/38*** | (2006.01) |
| ***H01Q 15/14*** | (2006.01) |
| ***H01Q 21/06*** | (2006.01) |
| ***H01Q 15/00*** | (2006.01) |
| ***H01Q 9/28*** | (2006.01) |
| ***H01Q 9/30*** | (2006.01) |
| ***H01Q 21/08*** | (2006.01) |
| ***H01Q 9/04*** | (2006.01) |

(52) U.S. Cl.
CPC ..... *H01Q 9/285* (2013.01); *H01Q 9/30* (2013.01); *H01Q 15/0086* (2013.01); *H01Q 15/14* (2013.01); *H01Q 21/061* (2013.01); *H01Q 21/08* (2013.01)

(58) Field of Classification Search
USPC ..... 343/835, 799, 815, 832, 893
See application file for complete search history.

(56) References Cited

U.S. PATENT DOCUMENTS

| | | | | |
|---|---|---|---|---|
| 2013/0002490 | A1* | 1/2013 | Liu | H01Q 9/42 343/700 MS |
| 2013/0050032 | A1* | 2/2013 | Shiu | H01Q 1/24 343/702 |
| 2014/0140554 | A1* | 5/2014 | Ruaro | H04R 25/554 381/315 |
| 2016/0141754 | A1* | 5/2016 | Leyh | H01Q 3/247 342/372 |
| 2017/0186710 | A1* | 6/2017 | Yoon | H01L 23/15 |
| 2018/0294676 | A1* | 10/2018 | Davlantes | H02J 50/12 |

FOREIGN PATENT DOCUMENTS

| | | | |
|---|---|---|---|
| JP | 2009-153089 | A | 7/2009 |
| JP | 2013-93643 | A | 5/2013 |
| WO | 2013/027824 | A1 | 2/2013 |

* cited by examiner

ANTENNA AND WIRELESS COMMUNICATION DEVICE

CROSS REFERENCE TO RELATED APPLICATIONS

This application is a National Stage of International Application No. PCT/JP2016/058684 filed Mar. 18, 2016, claiming priority based on Japanese Patent Application No. 2015-055831 filed Mar. 19, 2015, the contents of all of which are incorporated herein by reference in their entirety.

TECHNICAL FIELD

The present invention relates to an antenna and a wireless communication device.

The present application claims the benefit of priority on Japanese Patent Application No. 2015-55831 filed on Mar. 19, 2015, the subject matter of which is hereby incorporated herein by reference.

BACKGROUND ART

Recently, radio interference has easily occurred in wireless communications due to increasing numbers of wireless communication lines. For this reason, wireless communications have been implemented using beam-forming technologies. In the beam-forming technology, the directivity is enhanced using an antenna for arranging multiple antenna elements in an array so as to transmit high radio waves towards a specific direction alone, thus suppressing radio interference. In general, the beam-forming technology for carrying out wireless communication in a specific direction is designed such that the interval of distance between a reflector and each antenna element is set to about one quarter of a wavelength, and therefore it is possible to intensify radio waves in a desired direction by way of the reflector configured to reflect part of radio waves emitted by antenna elements.

Patent Literature 1 discloses a technology for reducing a surface current on a ground plane mesh for an antenna. This technology uses a reflector which serves as a high-impedance surface controlled in surface impedance by way of periodical structures, so as to control phases of reflective waves at the reflector, thus reducing the distance between the reflector and each antenna element to be smaller than one quarter of a wavelength. Patent Literature 2 discloses a technology for realizing an antenna whose height can be lowered due to a wavelength reducing effect by use of a magnetic substance or a dielectric substance interposed between a dipole antenna and a reflector. Patent Literature 3 discloses an antenna device including a dielectric substrate having parallel surfaces for arranging radiating elements and a ground plane. In the antenna device, the dielectric substrate indicates anisotropy of a dielectric constant in a direction perpendicular to the extended direction of each radiating element having a linear shape. In addition, the dielectric substrate has multiple metal inclusions (or split rings) aligned perpendicular to the ground plane.

CITATION LIST

Patent Literature

Patent Literature 1: U.S. Pat. No. 6,262,495

Patent Literature 2: Japanese Patent Application Publication No. 2006-222873

Patent Literature 3: Japanese Patent Application Publication No. 2008-182338

SUMMARY OF INVENTION

Technical Problem

The antenna disclosed in Patent Literature 1 has difficulty in reducing the entire size of an antenna including a reflector since the reflector should be increased in thickness due to the structure for forming a high-impedance surface. Similarly, it is difficult for the technologies of Patent Literatures 2 and 3 to reduce antennas in size.

The present invention is made in consideration of the aforementioned problem, and therefore the present invention aims to provide an antenna which can be reduced in size irrespective of the structure including a dielectric substrate and a conductive reflector, and a wireless communication device furnished with the antenna.

Solution to Problem

In a first aspect of the invention, an antenna includes a conductive reflector, a dielectric substrate disposed on the conductive reflector, a radiation module that is disposed on the main surface of the dielectric substrate so as to emit radio waves, a power supply that is disposed on the main surface of the dielectric substrate so as to supply power to the radiation module, and a plurality of split-ring resonators that are disposed in an area between the radiation module and the conductive reflector on the main surface of the dielectric substrate. The conductive reflector reflects radio waves emitted by the radiation module towards the conductive reflector. Each of the split-ring resonators includes a split having first and second ends disposed oppositely and separated from each other, and a ring connected between the first and second ends.

In a second aspect of the present invention, a wireless communication device includes an antenna and a communication controller configured to carry out communication by means of the antenna.

Advantageous Effects of Invention

According to the present invention, it is possible to reduce an antenna in size. That is, it is possible to reduce the height of an antenna since it is possible to reduce the wavelength of electromagnetic waves occurring in the periphery of split-ring resonators (i.e. the wavelength of electromagnetic waves occurring in the area between a conductive reflector and a radiation module) at the operating frequency of a radiation module in an antenna.

DESCRIPTION OF EMBODIMENTS

The antennas of the present invention will be described in detail by way of embodiments with reference to the accompanying drawings.

First Embodiment

Figure 2:
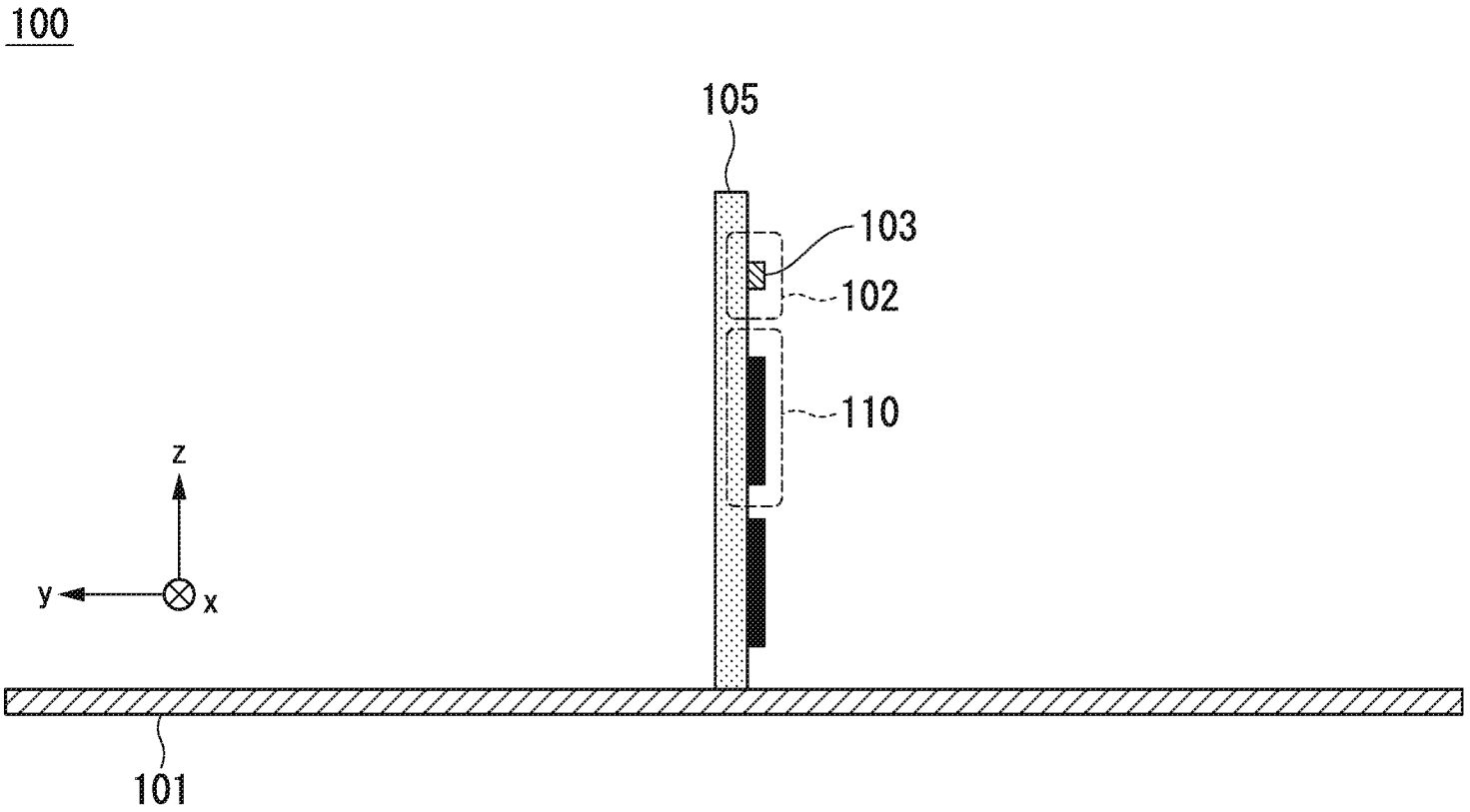
FIG. 2 is a left-side view of the antenna according to the first embodiment of the present invention.
Figure 12:
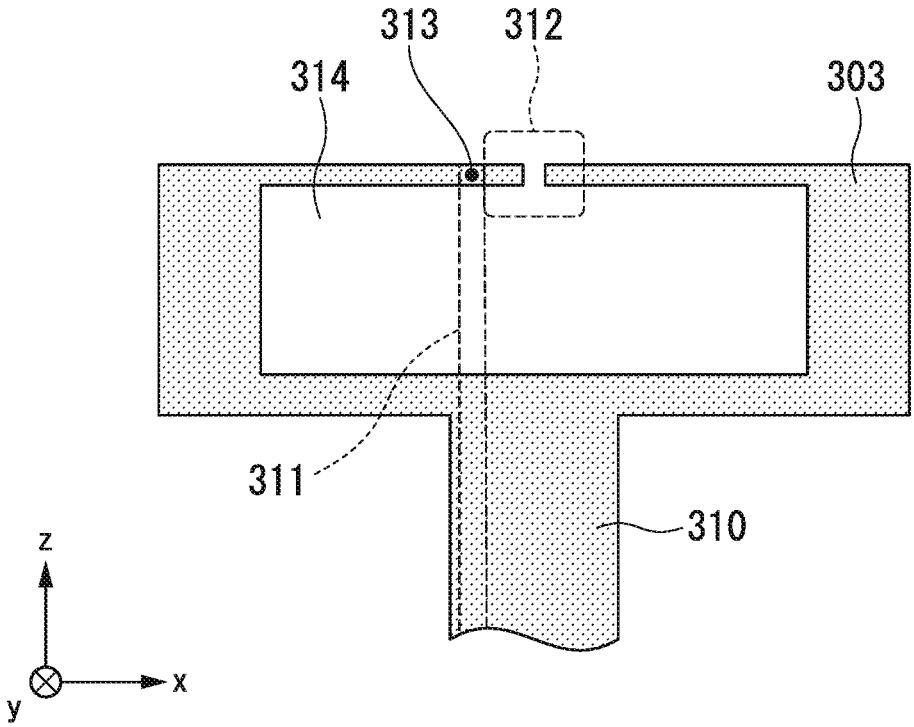
FIG. 12 is a perspective view showing a fourth variation of a radiation module disposed on a dielectric substrate in the antenna of the third embodiment.

FIG. 12 is a front view of an antenna 100 according to the first embodiment of the present invention. FIG. 2 is a left-side view of the antenna 100 according to the first embodiment. The antenna 100 includes a conductive reflector 101 and a dielectric substrate 105. As shown in FIG. 2, the dielectric substrate 105 is disposed perpendicular to the conductive reflector 101. The conductive reflector 101 is a conductive reflector having conductivity disposed on a two-dimensional plane (e.g. an X-Y plane). The dielectric substrate 105 is a dielectric substrate having non-conductivity. The dielectric substrate 105 includes a radiation module 102 and one or more split-ring resonators 110 disposed thereon. The conductive reflector 101 reflects radio waves emitted by the radiation module 102 in a direction toward the radiation module 102.

The radiation module 102 is disposed at a predetermined position of a surface layer on the main plane of the dielectric substrate 105 separated from the conductive reflector 101 by a predetermined distance. The radiation module 102 includes a first radiating element 103 (i.e. a first conductor) having a linear shape extended in a direction (e.g. a right direction in FIG. 1) from a power supply 104 which is disposed on the main surface of the dielectric substrate 105 so as to supply power to the radiation module 102. In addition, the radiation module 102 includes a second radiating element 103 (i.e. a second conductor) having a linear shape extended in another direction (e.g. a left direction in FIG. 1) from the power supply 104. The radiating elements 103 emit radio waves. The power supply 104 is connected to a radio frequency (RF) circuit (not shown) so as to supply power to the radiation module 102. At this time, the radiation module 102 operates as a dipole antenna.

A plurality of split-ring resonators 110 are disposed on the main surface of the dielectric substrate 105 in an area between the radiation module 102 and the conductive reflector 101. The spring-ring resonator 110 includes a split 112 having a first end and a second end separated from each other and a ring 111 connected between the first end and the second end. In this connection, an antenna body is configured of the dielectric substrate 105, the radiation module 102 disposed on the main surface of the dielectric substrate 105, and the split-ring resonators 110 disposed on the main surface of the dielectric substrate 105.

Figure 1:
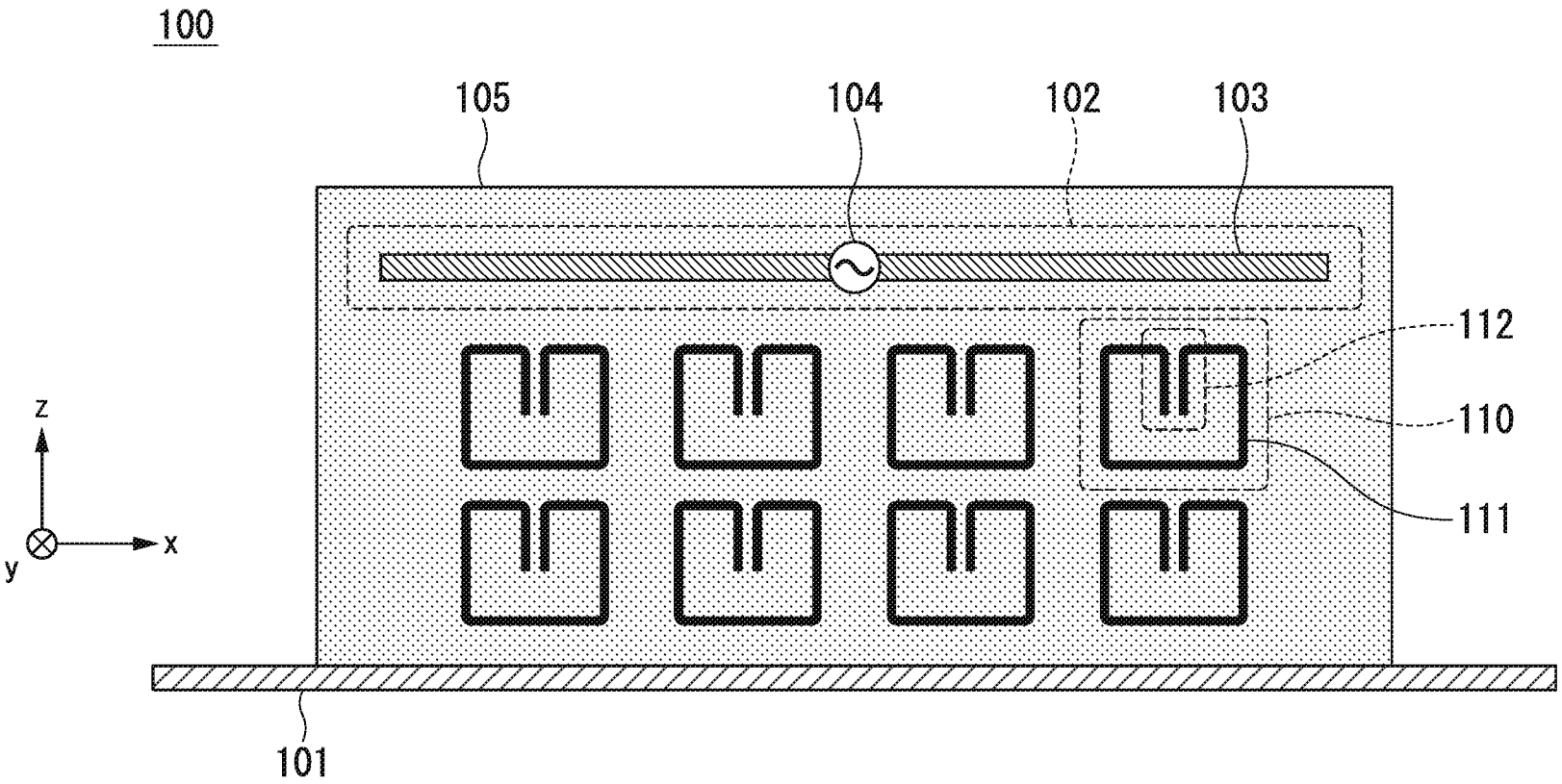
FIG. 1 is a front view of an antenna according to the first embodiment of the present invention.

FIGS. 1 and 2 show the antenna 100 including the radiation module 102 and the split-ring resonators 110 disposed on the surface layer on the main surface of the dielectric substrate 105. However, the antenna 100 of the first embodiment is not necessarily limited to the antenna configuration for forming the radiation module 102 and the split-ring resonators 110 on the surface layer of the dielectric substrate 105. In the antenna 100 of the first embodiment, the radiation module 102 and the split-ring resonators 110 may be disposed at least one of the surface layer and the interior layer on the main surface of the dielectric substrate 105.

In general, the radiation module 102 and the split-ring resonators 110 are made of copper foils, but they can be made of any material serving as a conductor other than copper foils. In addition, the radiation module 102 and the split-ring resonators 110 may be made of the same material, or they can be made of different materials.

In addition, the dielectric substrate 105 can be made of any non-conductive material. Moreover, it is not necessary to limit the manufacturing process for the dielectric substrate 105. For example, the dielectric substrate 105 may be a printed-circuit board using a glass epoxy resin. Alternatively, the dielectric substrate 105 may be a substrate using ceramics materials. As the substrate using ceramics materials, for example, it is possible to mention a low-temperature co-fired multilayer ceramics substrate produced by way of an LTCC (Low-Temperature Co-fired Ceramics) technology or the like.

In general, the conductive reflector 101 is made of a metal material. Specifically, the conductive reflector 101 is made of copper foils adhered to a dielectric substrate. However, the conductive reflector 101 applied to the antenna 100 of the first embodiment can be made of any conductive material.

In the antenna 100 of the first embodiment, the split-ring resonator 110 operates as an LC resonator based on an inductance of the ring 111 and a capacitance of the split 112. In addition, the radiation module 102 emits electromagnetic waves to generate a magnetic field by the split-ring resonator 110. The magnetic field may run through the ring 111. The split-ring resonator 110 resonates in a magnetic field running through the ring 111. Due to the interaction between the resonation of the split-ring resonator 110 and a magnetic field caused by electromagnetic waves emitted by the radiation module 102, effective magnetic permeability may change in the periphery of the split-ring resonator 110. In particular, when the split-ring resonator 110 resonates in the vicinity of the resonance frequency, effective magnetic permeability may change in the periphery of the split-ring resonator 110. For this reason, it is possible to reduce the wavelength of electromagnetic waves emitted by the radiation module 102 in the periphery of the split-ring resonator 110 by way of the resonation of the split-ring resonator 110 in the vicinity of the resonance frequency.

Therefore, it is possible to reduce the wavelength of electromagnetic waves in the periphery of the split-ring resonator 110 (i.e. the wavelength of electromagnetic waves in the area between the conductive reflector 101 and the radiation module 102) at the operating frequency of the radiation module 102 in the antenna 110 of the first embodiment. As a result, it is possible to reduce the height of the antenna 100. In this connection, the conductive reflector 101 can be made of any conductive material irrespective of the thickness thereof. Therefore, it is possible to reduce the thickness of the conductive reflector 101; hence, it is possible to reduce the height of the antenna 100 counting the thickness of the conductive reflector 101.

In the antenna 100 of the first embodiment, both the split-ring resonator 110 and the radiation module 102 are disposed in the same plane as the dielectric substrate 105, and therefore it is possible to reduce the height of the antenna 100 without using additional members or parts other than the split-ring resonators 110.

The antenna 100 shown in FIG. 1 includes eight split-ring resonators 110 in total. That is, four lines of split-ring resonators 110 are aligned in the width direction of the antenna 100 (i.e. the x-axis direction in FIG. 1) while two rows of split-ring resonators 110 are aligned in the height direction of the antenna 100 (i.e. the z-axis direction in FIG. 1). However, the antenna 100 of the first embodiment is not necessarily limited to the configuration of FIG. 1. For example, it is possible to align a single row of split-ring resonators 110 in the height direction of the antenna 100. In this case, it is possible to reduce the number of split-ring resonators 110 to one-stage alignment compared to two-stage alignment shown in FIG. 1, and therefore it is possible to reduce the height of the antenna 100 (i.e. the height of the dielectric substrate 105 accommodating the radiation module 102 and the split-ring resonators 110). Herein, fluctuations of magnetic permeability in the periphery of the split-ring resonators 110 may depend on the height of the antenna 100 since it is possible to increase the magnetic permeability in the periphery of the split-ring resonators 110 by increasing the number of split-ring resonators 110. For this reason, it is possible to minimize the height of the antenna 100 by way of one-stage alignment of the split-ring resonators 110 in the height direction of the antenna 100; however, it is unnecessary to limit the alignment of the split-ring resonators 110 to one-stage alignment in consideration of magnetic permeability. That is, it is preferable to design the antenna 100 in consideration of various parameters such as the oscillation frequency, the size of the split-ring resonator 110, and the material of the dielectric substrate 105.

Figure 3:
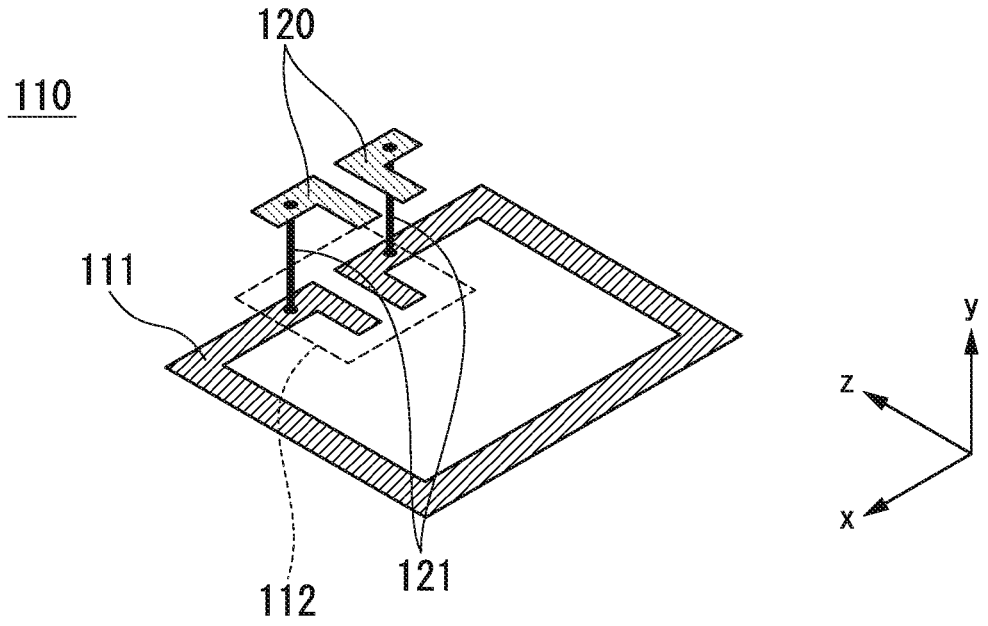
FIG. 3 is a perspective view showing a first variation of a split-ring resonator disposed on a dielectric substrate in the antenna of the first embodiment.

It is possible to reduce the resonance frequency of the split-ring resonator 110 by increasing an inductance with an elongated current path for increasing the size of the split-ring resonator 110 or by increasing a capacitance with a reduced distance between discontinuous conductors (i.e. an interval of distance between first and second ends). The method how to increase a capacitance of the split-ring resonator 110 will be described with reference to FIGS. 3 and 4. In the configuration of FIG. 3, a pair of conductive-vias 121 made of linear conductors are connected to the first and second ends on both sides of the split 112. To increase the capacitance of the split 112, a pair of auxiliary conductors 120 are attached to the conductive-vias 121 extended upwardly from the first and second ends on both sides of the split 112. In the configuration shown in FIG. 4, a conductive-via 121 is attached to either the first or second end of the split 112. To increase the capacitance of the split 112, an auxiliary conductor 120 is attached to the conductive-via 121 extended upwardly from one of the first and second ends of the split 112. Herein, the auxiliary conductors 120 are disposed in a different layer than the layer for forming the split-ring resonator 110. In addition, the auxiliary conductors 120 are electrically connected to the split 112 through the conductive-vias 121.

Figure 4:
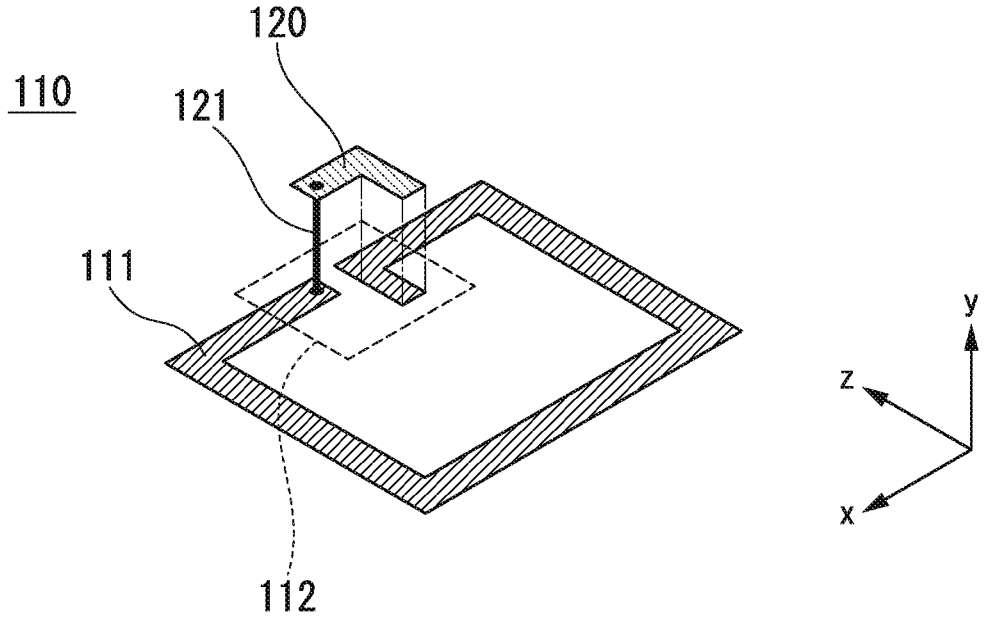
FIG. 4 is a perspective view showing a second variation of a split-ring resonator disposed on the dielectric substrate in the antenna of the first embodiment.

The configuration shown in FIG. 3 or FIG. 4 may increase the conductor area opposite to the split 112 of the split-ring resonator 110 by the amounts of auxiliary conductors 120; hence, it is possible to increase the capacitance without increasing the size of the split-ring resonator 110. In the configuration of FIG. 3, a pair of L-shaped auxiliary conductors 120 are positioned opposite to the first and second ends of the split 112 through a pair of conductive-vias 121. In the configuration of FIG. 4, the shape of the first end differs from the shape of the second end in the split 112. For example, the conductive-via 121 is attached to the first end of the split 112 while the L-shaped auxiliary conductor 120 is connected to the distal end of the conductive-via 121, and therefore part of the auxiliary conductor 120 is positioned opposite to the second end of the split 112. That is, the auxiliary conductor 120 is connected to the first end of the split 112 through the conductive-via 121, whereas the auxiliary conductor 120 may overlap the second end of the split 112 in the y-axis direction. Due to the configuration shown in FIG. 3 or FIG. 4, it is possible to further increase the conductor area opposite to the split 112; hence, it is possible to efficiently increase the capacitance without increasing the size of the split-ring resonator 110.

Second Embodiment

Next, an antenna 200 according to the second embodiment of the present invention will be described with reference to FIG. 5. Similar to the antenna 100, the antenna 200 includes the conductive reflector 101 and the dielectric substrate 105. The dielectric substrate 105 is equipped with a radiation module 202 and a radiating element 203 in addition to the power supply 104 and a plurality of split-ring resonators 110. The antenna 200 of the second embodiment differs from the antenna 100 of the first embodiment in terms of the following points.

(1) The radiation module 202 includes an L-shaped conductor extended from the power supply 104 on the main surface of the dielectric substrate 105. The power supply 104 supplies power to the radiation module 202.

(2) The radiation module 202 includes the radiating element 203 and the power supply 104.

(3) The radiating element 203 emits radio waves.

(4) The radiating element 203 having an L-shape is disposed in the surface layer of the dielectric substrate 105. Part of the radiating element 203 forms a conductor parallel to the conductive reflector 101 for reflecting radio waves, emitted by the radiating element 203, in a direction toward the radiation module 202.

(5) The power supply 104 is connected to a radio frequency (RF) circuit (not shown) so as to supply power to the radiation module 202. One end of the power supply 104 is connected to the lower end of the radiating element 203 while the other end is connected to the conductive reflector 101.

The aforementioned radiation module 202 operates as a reverse L-shaped antenna. In addition, a plurality of split-ring resonators 110 are disposed in the area between the conductive reflector 101 and the conductor of the radiating element 203 parallel to the radiating element 203 on the main surface of the dielectric substrate 105.

The split-ring resonator 110 generates a magnetic field due to electromagnetic waves emitted by the radiation module 202. The magnetic field may run through the ring 111 of the split-ring resonator 110. The split-ring resonator 110 resonates due to a magnetic field running through the ring 111. Thus, the effective magnetic permeability in the periphery of the split-ring resonator 110 may be changed by way of the interaction between the resonation of the split-ring resonator 110 and a magnetic field that occurs due to electromagnetic waves emitted by the radiation module 202. In particular, the effective magnetic permeability in the periphery of the split-ring resonator 110 may be increased by way of the resonation occurring in the vicinity of the resonance frequency of the split-ring resonator 110. Due to the resonation occurring in the vicinity of the resonance frequency of the split-ring resonator 110, it is possible to reduce the wavelength of electromagnetic waves, emitted by the radiation module 202, in the periphery of the split-ring resonator 110.

Therefore, it is possible for the antenna 200 of the second embodiment to reduce the wavelength of electromagnetic waves around the split-ring resonators 110 (i.e. the wavelength of electromagnetic waves in the area between the conductive reflector 101 and the radiation module 202) at the operating frequency of the radiation module 202. As a result; it is possible to reduce the height of the antenna 200. In addition, the conductive reflector 101 can be made of any conductive material irrespective of its thickness. Therefore, it is possible to reduce the thickness of the conductive reflector 101, and therefore it is possible to reduce the height of the antenna 200 counting the thickness of the conductive reflector 101.

Figure 5:
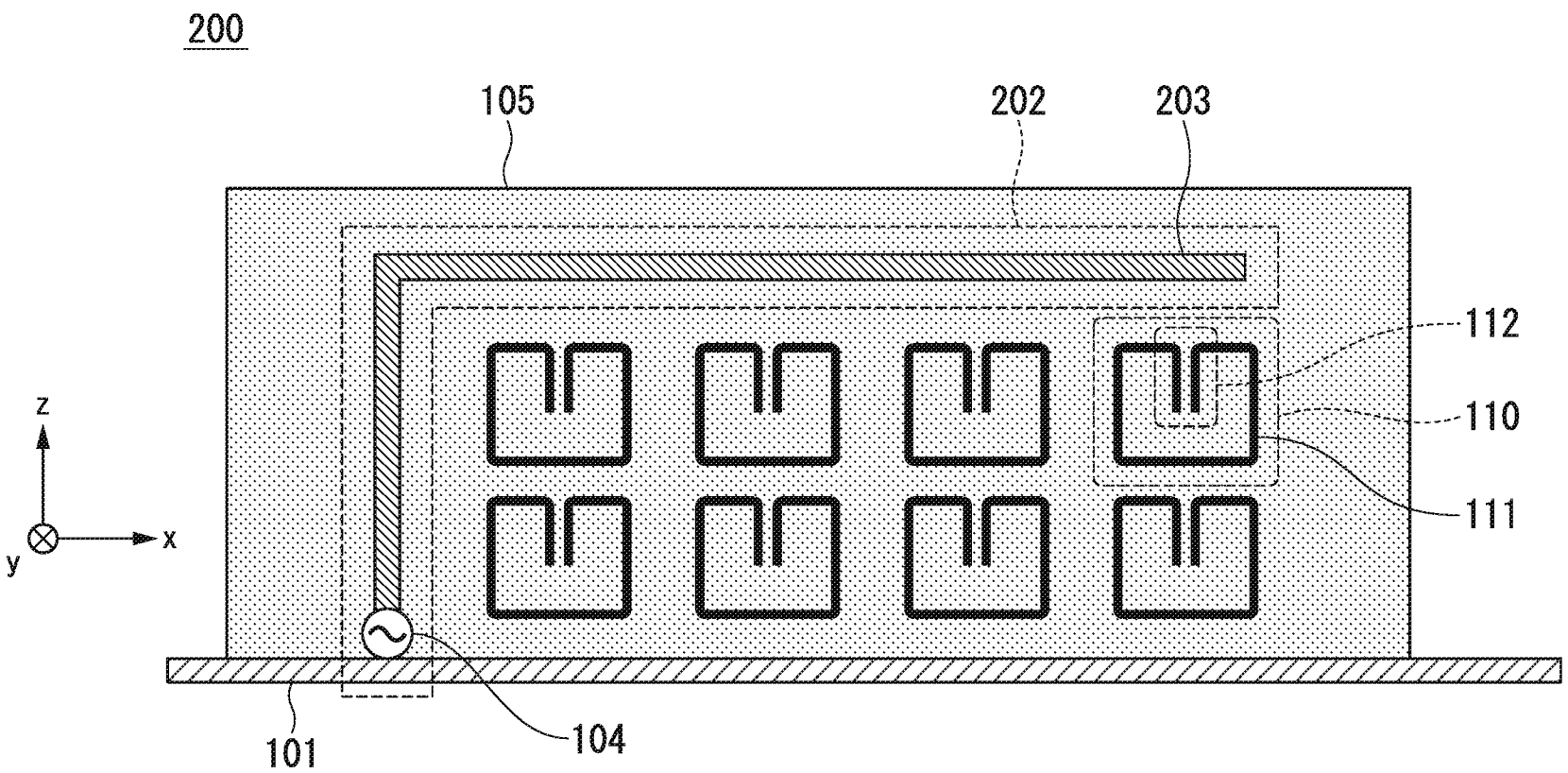
FIG. 5 is a front view of an antenna according to the second embodiment of the present invention.
Figure 6:
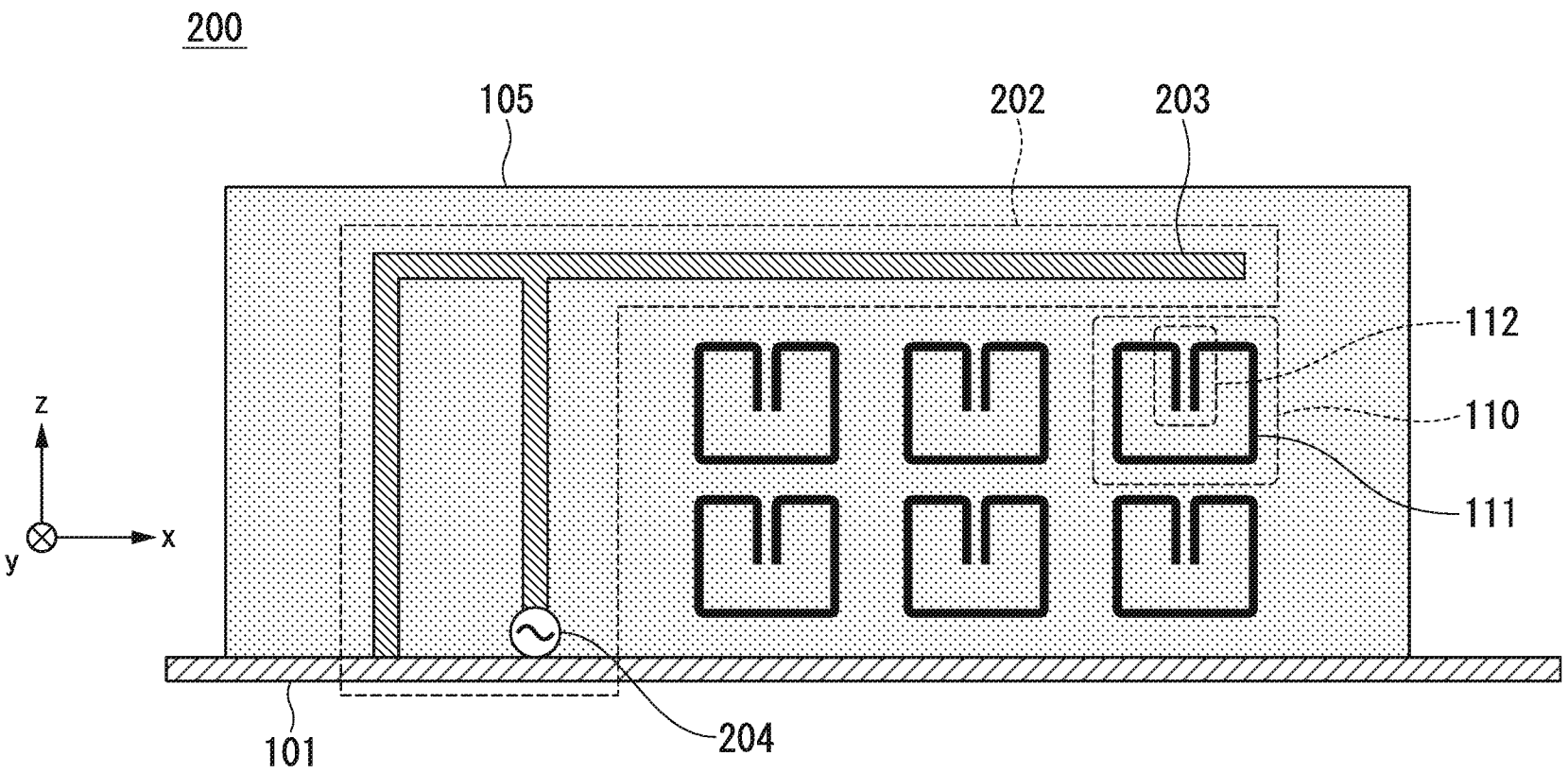
FIG. 6 is a front view of an antenna according to a variation of the second embodiment of the present invention.

The antenna 200 shown in FIG. 5 uses a reverse L-shaped antenna as the radiation module 202; but this is not a limitation. It is possible to use any variation such as a monopole antenna as the radiation module 202. Alternatively, as shown in FIG. 6, it is possible to use a reverse F-shape antenna as the radiating element 203 of the radiation module 202.

Third Embodiment

Next, an antenna 300 according to the third embodiment of the present invention will be described with reference to FIGS. 7 and 8. The antenna 300 includes the conductive reflector 101 and a dielectric substrate 305. A plurality of split-ring resonators 110 are aligned on the main surface of the dielectric substrate 305. The antenna 300 of the third embodiment differs from the antenna 100 of the first embodiment in terms of the following points.

(1) A radiation module 302 disposed on the main surface of the dielectric substrate 305 includes a power supply 304, a radiation-module resonator part 306, a feeder 311, and a conductive-via 313.

Figure 7:
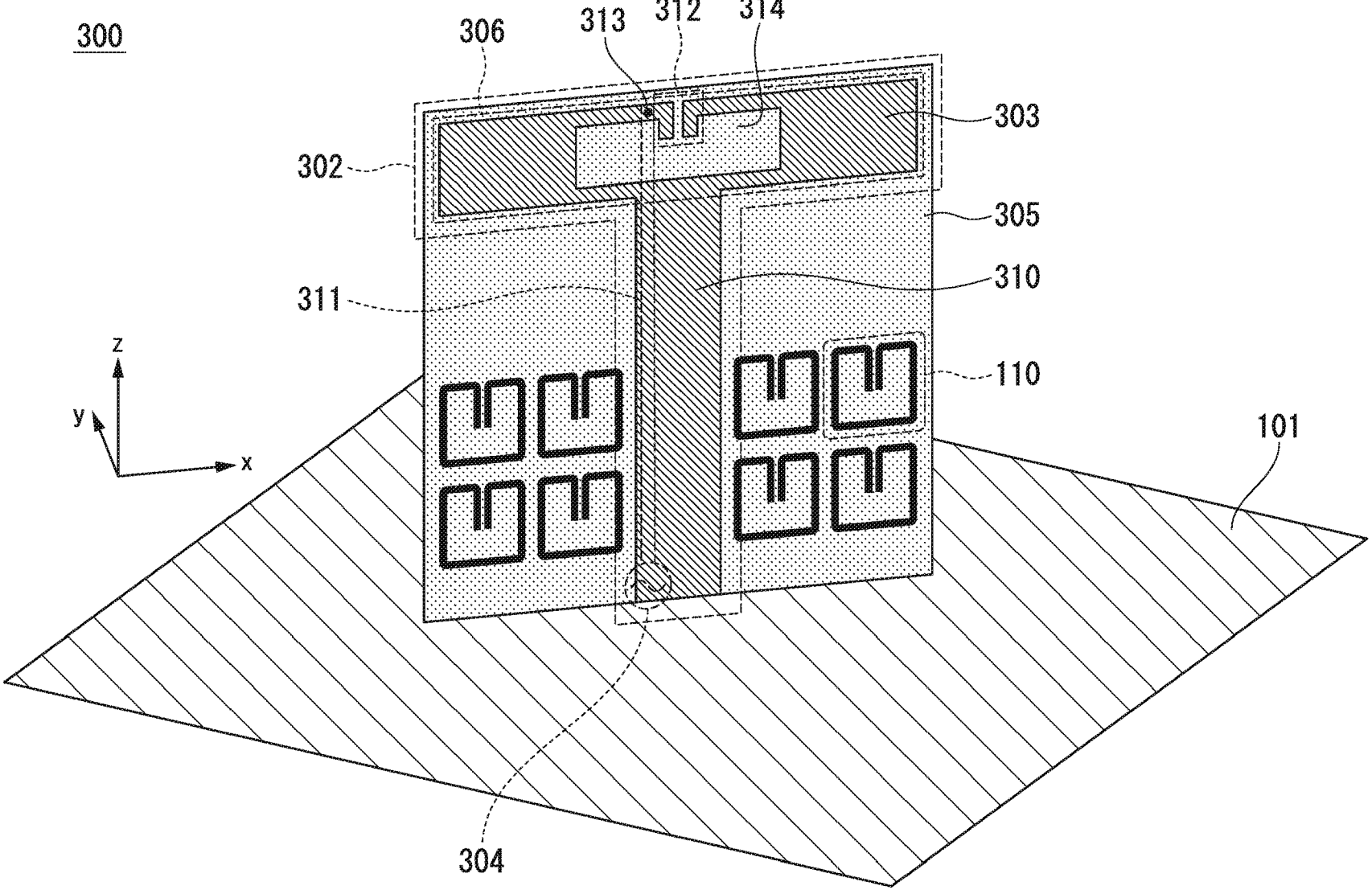
FIG. 7 is a perspective view showing the front side of an antenna according to the third embodiment of the present invention.

(2) The radiation-module resonator part 306 is disposed on the main surface of the dielectric substrate 305 (i.e. the surface of an x-z plane in view of a negative direction of a y-axis in FIG. 7). The radiation-module resonator part 306 includes a radiation-module split part 312 and a radiation-module ring part 303. An area inside the radiation-module ring part 303 will be referred to as an opening 314.

(3) The radiation-module resonator part 306 includes a radiation-module split part 312 having two ends (e.g. third and fourth ends) that are separated and disposed opposite to each other, and the radiation-module ring part 303 connected between two ends. The radiation-module resonator 306 is disposed on the main surface of the dielectric substrate 305. The radiation-module resonator part 306 having a C-shape encompasses the opening 314 while forming the radiation-module split part 312 partially in a circumferential direction. The radiation-module split part 312 is disposed on the main surface of the dielectric substrate 305.

(4) The power supply 304 is connected to a radio frequency (RF) circuit (not shown) so as to supply power to the radiation module 302. Herein, one end of the power supply 304 is connected to one end of the feeder 311 while the other end is connected to the conductive reflector 101.

Figure 8:
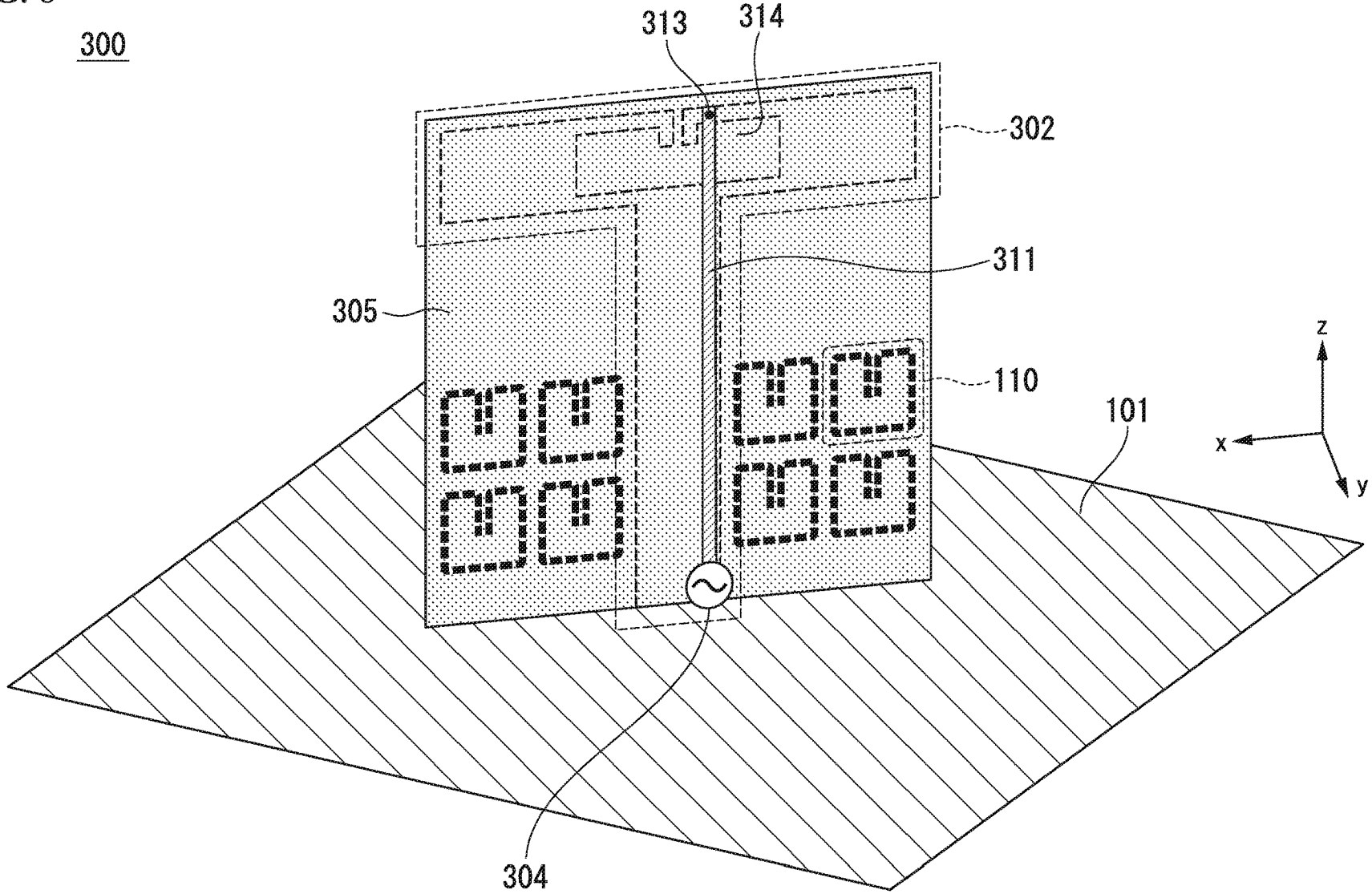
FIG. 8 is a perspective view showing the rear side of the antenna according to the third embodiment of the present invention.

(5) The feeder 311 is disposed in the rear face on the main surface of the dielectric substrate 305 (i.e. a surface of an x-z plane in view of a positive direction of a y-axis in FIG. 8. The feeder 311 is a conductor having a linear shape. One end of the feeder 311 is connected to the power supply 304 while the other end is connected to the conductive-via 313 that is positioned in a far side (i.e. a positive-direction side of a z-axis) distanced from the conductive reflector 101 in the radiation-module resonator part 306. An interconnection part 310 disposed on the surface of the dielectric substrate 305 overlaps the feeder 311 disposed on the rear face of the dielectric substrate 305 in a y-axis direction. That is, the feeder 311 is disposed at a position overlapping the interconnection part 310 in view of the main surface of the dielectric substrate 305. The feeder 311 is extended from the power supply 304 so as to reach the radiation-module ring part 303 across the internal area (i.e. the opening 314) of the radiation-module ring 303.

(6) The interconnection part 310 is a conductor extended in a z-axis direction on the main surface of the dielectric substrate 305. The interconnection part 310 electrically connects the radiation-module resonator part 306 and the conductive reflector 101. One end of the interconnection part 310 is connected to the center of the radiation-module resonator part 306 positioned in a near side (i.e. a negative-direction side of a z-axis) relative to the conductive reflector 101. The other end of the interconnection part 310 is connected to the conductive reflector 101.

In general, the conductive-via 313 is formed by effecting a plating process for a through-hole which is formed in the dielectric substrate 305 by use of a drill. Herein, the conductive-via 313 needs to electrically connect different conductive layers. For example, the conductive-via 313 may be a laser-via formed using a laser or another via formed using a copper line.

In the antenna 300 shown in FIGS. 7 and 8, the radiation-module resonator part 306 is disposed on the main surface of the dielectric substrate 305 while the feeder 3311 is disposed in the rear face on the main surface of the dielectric substrate 305; but this is not a restriction. Herein, the radiation-module resonator part 306 and the feeder 311 need to be disposed in different conductive layers in the dielectric substrate 305. For example, the radiation-module resonator part 306 is disposed on the main surface of the dielectric substrate 305 while the feeder 311 is disposed in a conductive layer inside the dielectric substrate 305.

In the antenna 300 of the third embodiment, the radiation-module resonator part 306 operates as an LC-series resonant circuit (i.e. a split-ring resonator) using an inductance formed along a C-shape conductor encompassing the opening 314 and a capacitance formed between opposite conductors (i.e. the third and fourth ends) of the radiation-module split part 312. A relatively high current flows through the radiation-module resonator part 306 in the vicinity of the resonance frequency of the split-ring resonator 110, and therefore part of current may contribute to radio-wave emission so as to realize an operation of an antenna.

The feeder 311 is subjected to capacitive coupling with the interconnection part 310, and therefore the feeder 311 coupled with the interconnection part 310 and the dielectric substrate 305 may form a transmission line. As a result, an RF signal output from the power supply 304 is transmitted through the feeder 311 and supplied to the radiation-module resonator part 306.

In the antenna 300 of the third embodiment, the radiation-module resonator part 306 operates as an antenna. A magnetic field is caused to occur due to electromagnetic waves emitted by the radiation-module resonator part 306. The magnetic field runs through the rings 111 of the split-ring resonators 110. The split-ring resonators 110 resonate in a magnetic field running through the rings 111. Due to interaction between the resonation of the split-ring resonators 110 and the magnetic field occurring due to electromagnetic waves emitted by the radiation-module resonator part 306, the effective magnetic permeability may be changed in the periphery of the split-ring resonators 110. In particular, the effective magnetic permeability in the periphery of the split-ring resonators 110 is increased when the split-ring resonators 110 resonates in the vicinity of the resonance frequency thereof. For this reason, it is possible to reduce the wavelength of electromagnetic waves emitted by the radiation-module resonator part 306 in the periphery of the split-ring resonators 110 by way of resonation of the split-ring resonators 110 in the vicinity of their resonance frequency.

In the antenna 300 of the third embodiment, it is possible to reduce the wavelength of electromagnetic waves in the periphery of the split-ring resonators 110 (i.e. the wavelength of electromagnetic waves occurring in the area between the conductive reflector 101 and the radiation-module resonator part 306) at the operating frequency of the radiation-module resonator part 306. As a result, it is possible to reduce the height of the antenna 300. In this connection, the conductive reflector 101 can be made of any conductive material irrespective of the thickness of the conductive reflector 101. That is, it is possible to reduce the thickness of the conductive reflector 101, and therefore it is possible to reduce the height of the antenna 300 counting the thickness of the conductive reflector 101.

In the antenna 300 of the third embodiment, the radiation-module resonator part 306 operates as an LC-series resonant circuit. A relatively high current flows through the radiation-module resonator part 306 in the vicinity of the resonance frequency of the split-ring resonators 110, and therefore part of current may contribute to radio-wave emission, thus realizing an operation of an antenna.

In the antenna 300 of the third embodiment, it is possible to reduce the resonance frequency by increasing an inductance with an enlarged size of a ring in the radiation-module resonator part 306 or by increasing a capacitance with a reduced interval of distance between the opposite conductors at the radiation-module split 312. In addition, it is possible to reduce the resonance frequency by connecting auxiliary conductors 320 to the radiation-module split 312 while using an antenna as the radiation-module resonator part 306 operating as an LC-series resonant circuit.

Figure 9:
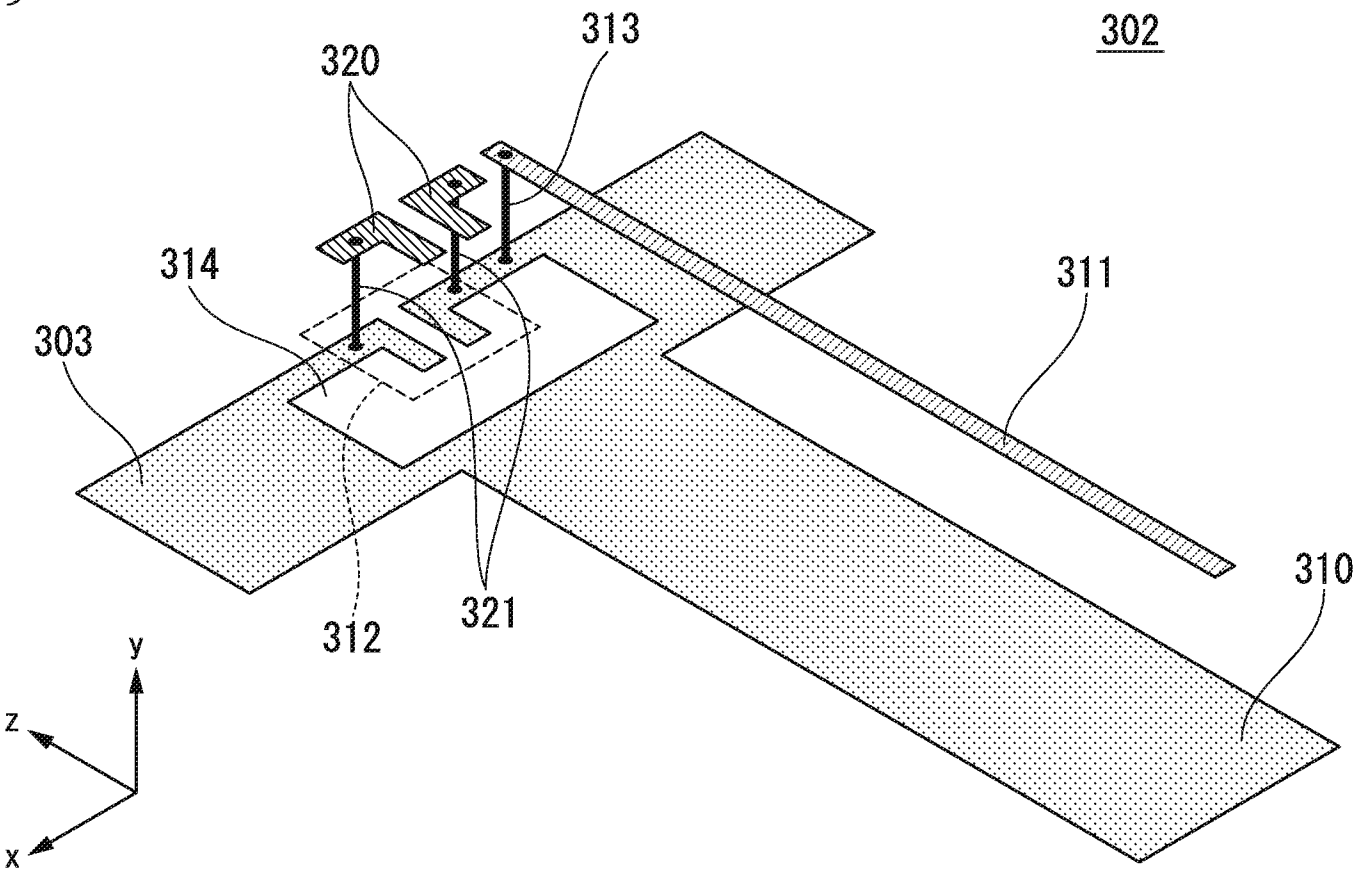
FIG. 9 is a perspective view showing a first variation of a radiation module disposed on a dielectric substrate in the antenna of the third embodiment.
Figure 10:
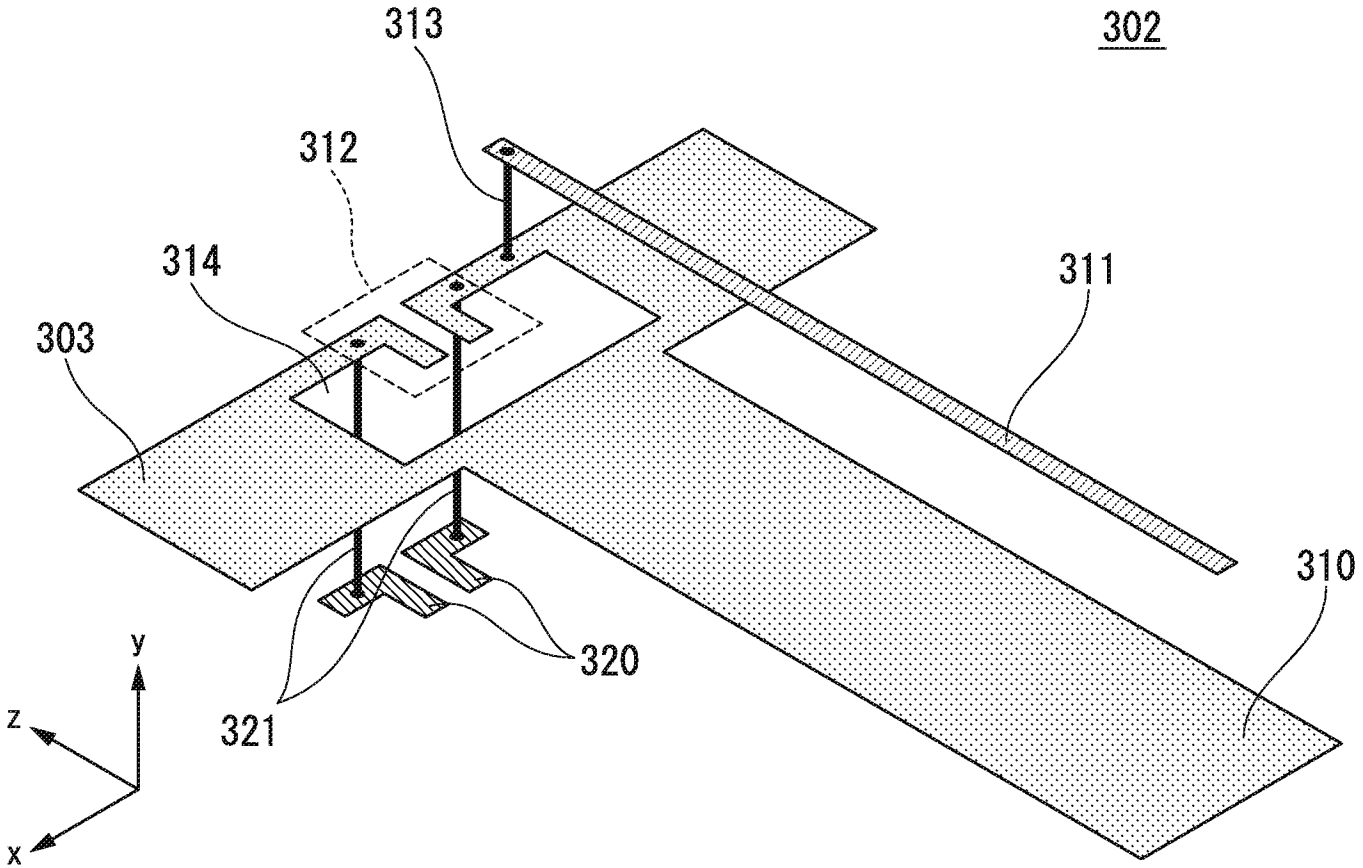
FIG. 10 is a perspective view showing a second variation of a radiation module disposed on a dielectric substrate in the antenna of the third embodiment.
Figure 11:
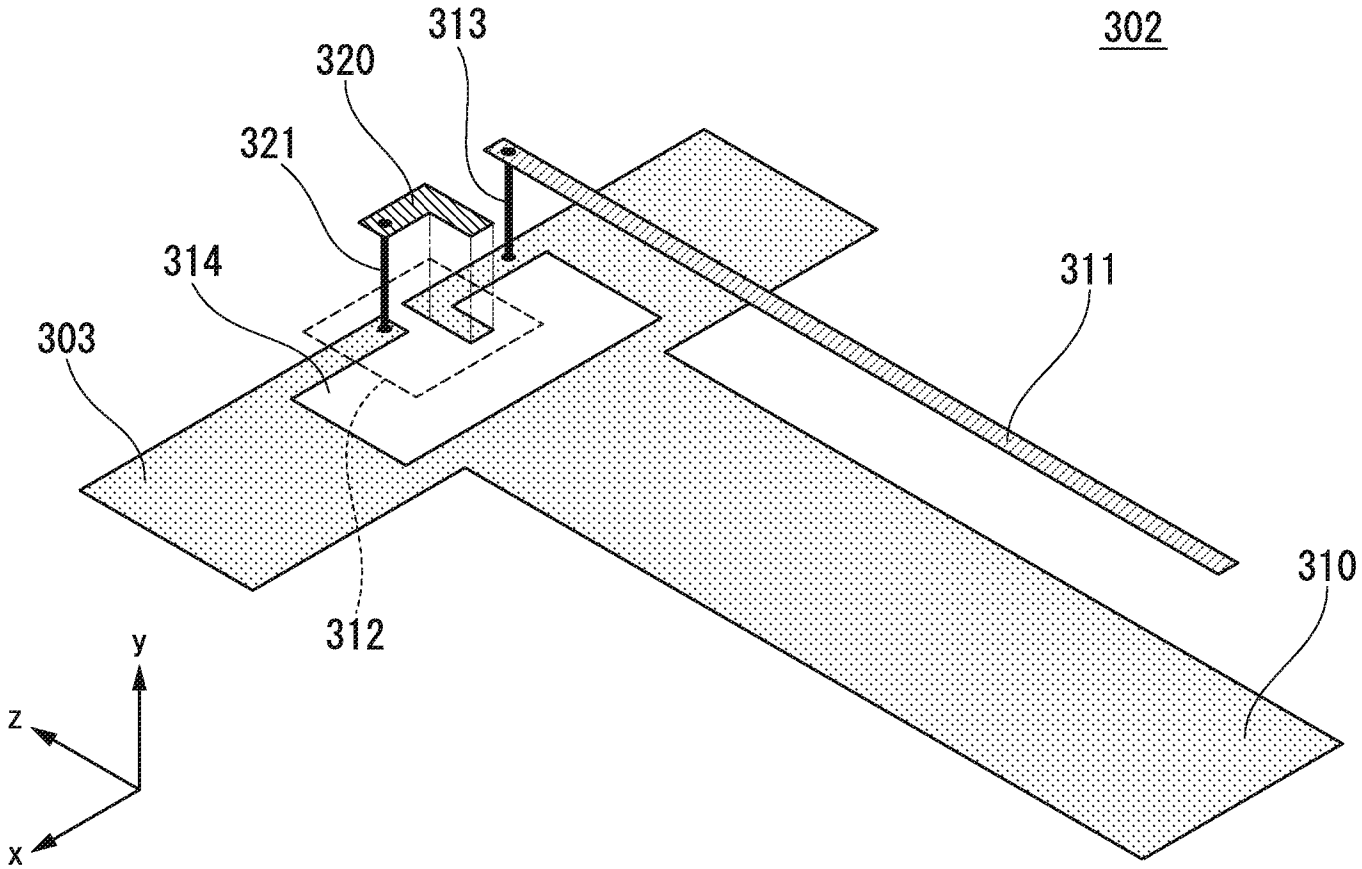
FIG. 11 is a perspective view showing a third variation of a radiation module disposed on a dielectric substrate in the antenna of the third embodiment.

It is possible to use the configurations shown in FIGS. 9 to 11 as a method for increasing the capacitance of the radiation-module split 312. FIG. 9 is a perspective view showing a first variation of the radiation module 302. In the radiation module 302 of FIG. 9, a pair of L-shaped auxiliary conductors 320 are disposed in the same layer as the feeder 311 in the dielectric substrate 305. A pair of auxiliary conductors 320 are electrically connected to a pair of opposite ends at the radiation-module split 312 through a pair of conductive-vias 321. A pair of auxiliary conductors 320 serving as independent conductors are disposed in the same layer as the feeder 311. In addition, the auxiliary conductors 320 are disposed in a different layer than the layer for forming the radiation-module resonator part 306.

FIG. 10 is a perspective view showing a second variation of the radiation module 302. In the radiation module 302 of FIG. 10, a pair of L-shaped auxiliary conductors 320 are disposed in a different layer than the layer for forming the radiation-module resonator part 306. A pair of auxiliary conductors 320 are electrically connected to a pair of opposite ends at the radiation-module split 312 through a pair of conductive-vias 321. In this connection, a pair of auxiliary conductors 320 are disposed in a layer opposite to the layer for forming the feeder 311 with respect to the layer for forming the radiation-module resonator part 306.

FIG. 11 is a perspective view showing a third variation of the radiation module 302. In the radiation module of FIG. 11, the L-shaped auxiliary conductor 320 is disposed in a different layer than the layer for forming the radiation-module resonator part 306. The auxiliary conductor 320 is electrically connected to one end of the radiation-module split 312 through the conductive-via 321 but disposed opposite to the other end of the radiation-module split 312. The auxiliary conductor 320 serving as an independent conductor s disposed in the same layer as the feeder 311. In addition, part of the auxiliary conductor 320 overlaps the other end of the radiation-module split 312 in a positive direction of a y-axis in FIG. 11.

Due to the configurations of the radiation module 302 shown in FIGS. 9 to 11, it is possible to further increase the conductor area disposed opposite to the radiation-module split 312, and therefore it is possible to efficiently increase the capacitance of the radiation-module split 312 without increasing the size of the radiation-module resonator part 306.

As a method for reducing the capacitance of the radiation-module split 312, it is possible to use the configuration shown in FIG. 12. FIG. 12 is a front view showing a fourth variation of the radiation module 302. The configuration of FIG. 12 aims to reduce a pair of opposite ends in area at the radiation-module split 312. This makes it possible to reduce the capacitance of the radiation-module split 312; hence, it is possible to increase the resonance frequency of the radiation-module resonator part 306.

To obtain a desired emission efficiency, it is preferable that the radiation-module resonator part 306 be an elongated shape in the expanse of the conductive reflector 101 on the main surface of the dielectric substrate 305. In the case of the radiation-module resonator part 306 shown in FIG. 7, for example, it is preferable to elongate the radiation-module resonator part 306 in an x-axis direction in order to obtain a desired emission efficiency. In FIG. 7, the radiation-module resonator part 306 has a rectangular shape; but this is not a restriction. For example, the radiation-module resonator part 306 may be disposed in an elliptical shape or a bow-tie shape. To obtain a desired emission efficiency with the radiation-module resonator part 306 having an elliptical shape or a bow-tie shape, it is preferable that the conductive reflector 101 be an elongated shape in the expanse of the conductive reflector 101 on the main surface of the dielectric substrate 305.

Figure 13:
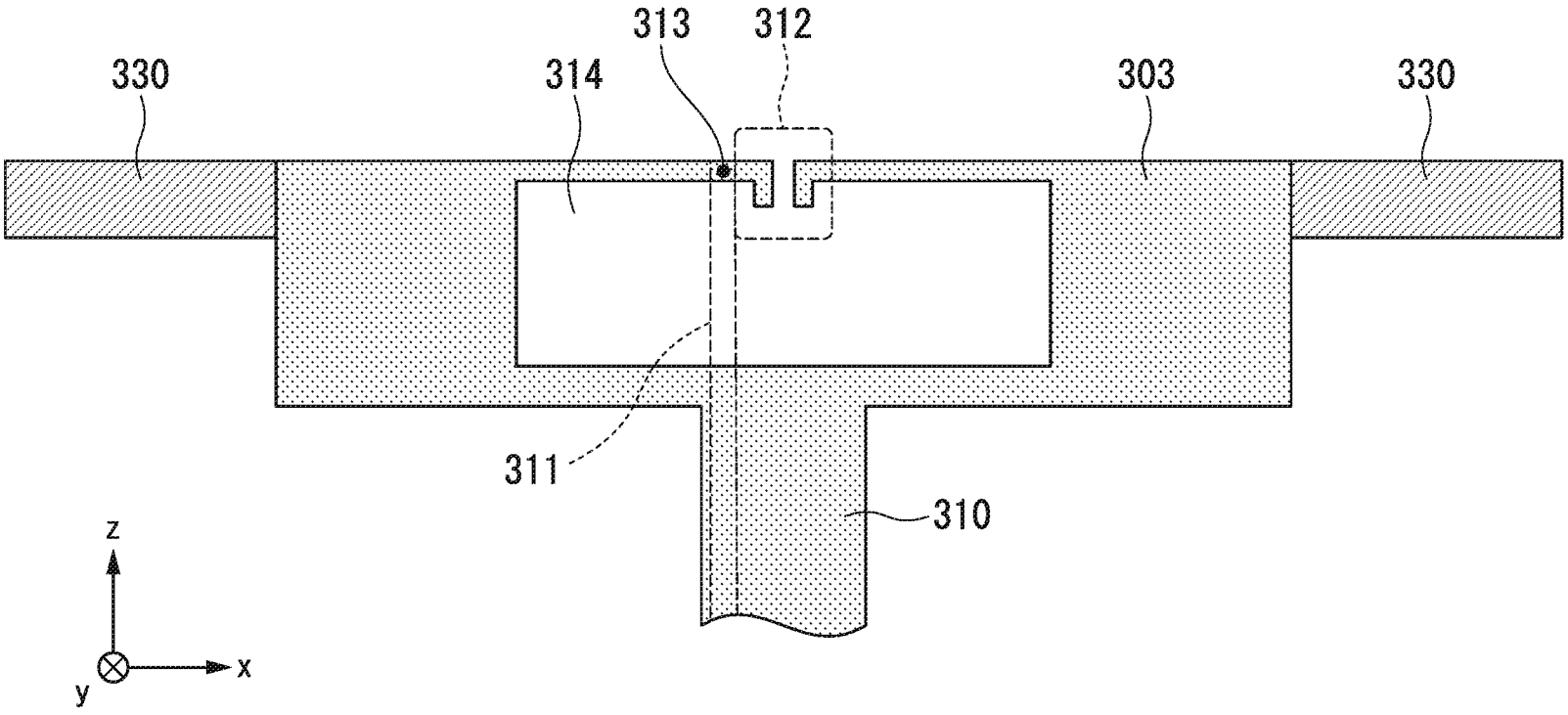
FIG. 13 is a perspective view showing a fifth variation of a radiation module disposed on a dielectric substrate in the antenna of the third embodiment.
Figure 14:
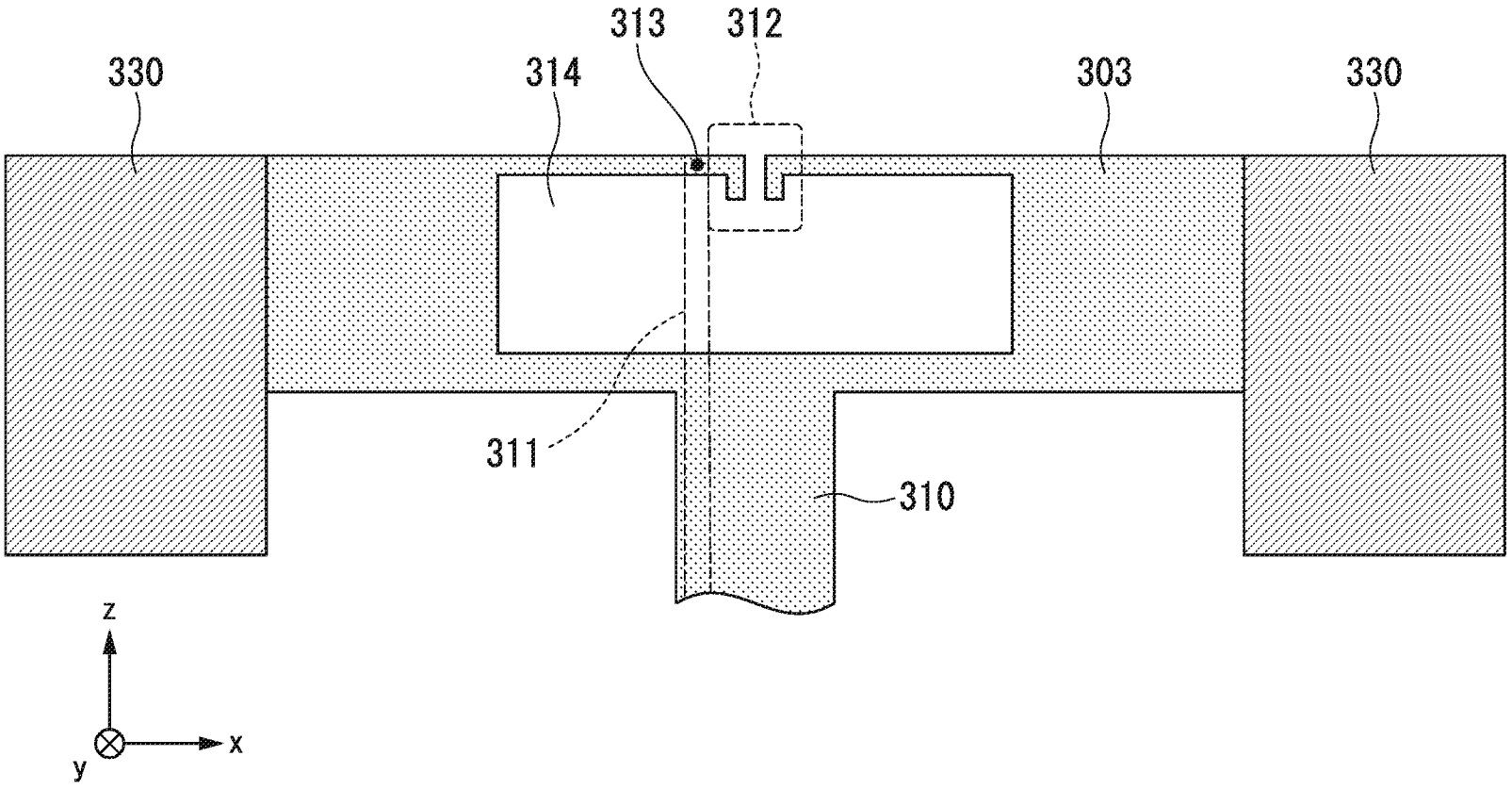
FIG. 14 is a perspective view showing a sixth variation of a radiation module disposed on a dielectric substrate in the antenna of the third embodiment.

The radiation-module resonator part 306 may be equipped with radiation parts having conductivity at opposite ends, extended in the expanse of the conductive reflector 101, on the main surface of the dielectric substrate 305. FIG. 13 is a front view showing a fifth variation of the radiation module 302. In FIG. 13, a pair of radiation parts 330 are attached to the opposite ends of the radiation-module resonator part 306. The height of the radiation part 330 is smaller than the height of the radiation-module resonator 306 (i.e. the length in a z-axis direction). FIG. 14 is a front view showing a sixth variation of the radiation module 302. In FIG. 14, a pair of radiation parts 330 are attached to the opposite ends of the radiation-module resonator part 306. The height of the radiation part 330 is larger than the height of the radiation-module resonator part 306 (i.e. the length in a z-axis direction).

Due to the configuration of FIG. 13 or FIG. 14, it is possible to guide a current flowing in an x-axis direction; which may contribute to the radio-wave emission of the radiation-module resonator part 306, to the radiation parts 330. This results in an improvement of the emission efficiency of the radiation-module resonator part 306. In FIGS. 13 and 14, the height of the radiation part 330 differs from the height of the radiation-module resonator part 306; but this is not a restriction. For example, it is possible to attach the radiation parts 330, having the same height of the radiation-module resonator parts 306, to the radiation-module resonator part 306.

Figure 15:
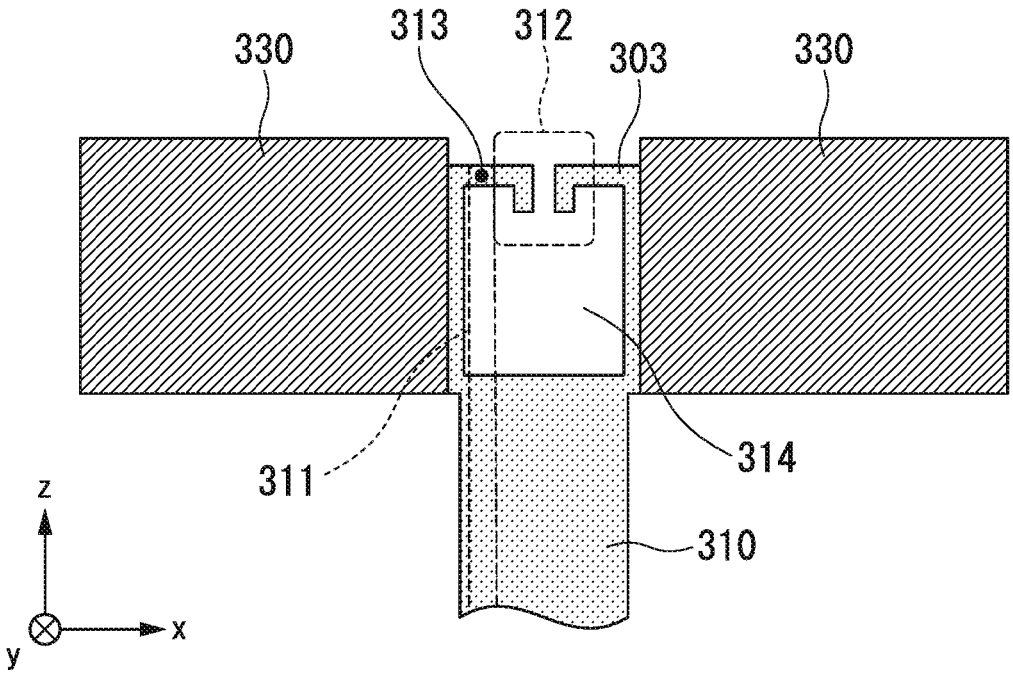
FIG. 15 is a perspective view showing a seventh variation of a radiation module disposed on a dielectric substrate in the antenna of the third embodiment.

As described above, when the radiation parts 330 are attached to the opposite ends of the radiation-module resonator part 306, the assembly combining the radiation parts 330 and the radiation-module resonator part 306, disposed on the main surface of the dielectric substrate 305, may have an elongated shape in the expanse of the conductive reflector 101. For this reason, the radiation-module resonator part 306 itself may not necessarily have an elongated shape in the expanse of the conductive reflector 101. FIG. 15 is a front view showing a seventh variation of the radiation module 302. As shown in FIG. 15, the radiation-module resonator part 306 may have a rectangular shape elongated in the height direction. Alternatively, it is possible to form the radiation-module resonator part 306 in a square shape, a circular shape, or a triangular shape.

The characteristic impedance of a transmission line made of the feeder 311 and the interconnection part 310 can be designed based on the width of the feeder 311 and the interval of distance between the layers for forming the feeder 311 and the interconnection part 310. For this reason, it is possible to supply power to an antenna without causing any reflection of signals, output from an RF circuit, at the terminal(s) of the transmission line by way of matching between the characteristic impedance of the transmission line and the impedance of the RF circuit. However, the effect of the present invention may not be substantially affected by mismatching between the characteristic impedance of the transmission line and the impedance of the RF circuit. In the radiation module 302 of the antenna 300 of the third embodiment, it is possible to secure impedance matching between the feeder 311 and the split-ring resonators 110 by adjusting the connected position between the feeder 311 and the radiation-module resonator part 306.

In the antenna 300, a virtual ground plane is formed in a y-z plane, including the center portion of the radiation-module resonator part 306, perpendicular to an x-axis. It is preferable that the interconnection part 310 of the radiation module 302 be positioned in proximity to the virtual ground plane while the extended direction of the interconnection part 310 be laid along the virtual ground plane. Specifically, it is possible to approximately assume a ground as an area whose size may fall within one quarter of the size of the radiation-module resonator part 306 in an x-axis direction, which may be expanded in a positive x-axis direction or a negative x-axis direction in view of the virtual ground plane, or one quarter of the size of the assembly combining the radiation-module resonator part 306 and the radiation parts 330 in an x-axis direction. For this reason, it is preferable that the interconnection part 310 be positioned within the aforementioned range. Herein, the virtual ground plane refers to a plane having zero potential. In the present embodiment, the y-z plane, e.g. a mirror-image plane of the radiation-module resonator part 306, may serve as the virtual ground plane. The electromagnetic-field distribution will not be changed in the antenna 300 irrespective of the existence/nonexistence of any metal in the virtual ground plane. That is, the electromagnetic-field distribution will not be affected by any metal disposed in the virtual ground plane.

For this reason, it is preferable that the size of the interconnection part 310 of the radiation module 302 in an x-axis direction be equal to or smaller than a half the size of the radiation-module resonator part 306 in an x-axis direction or a half the size of the assembly combining the radiation-module resonator part 306 and the radiation parts 330 in an x-axis direction. However, the effect of the present invention will not be substantially affected by the positioning of the interconnection part 330, which may be out of the aforementioned range. In addition, the effect of the present invention will not be substantially affected by the size of the interconnection part 310 in an x-axis direction, which may be out of the aforementioned range.

Figure 16:
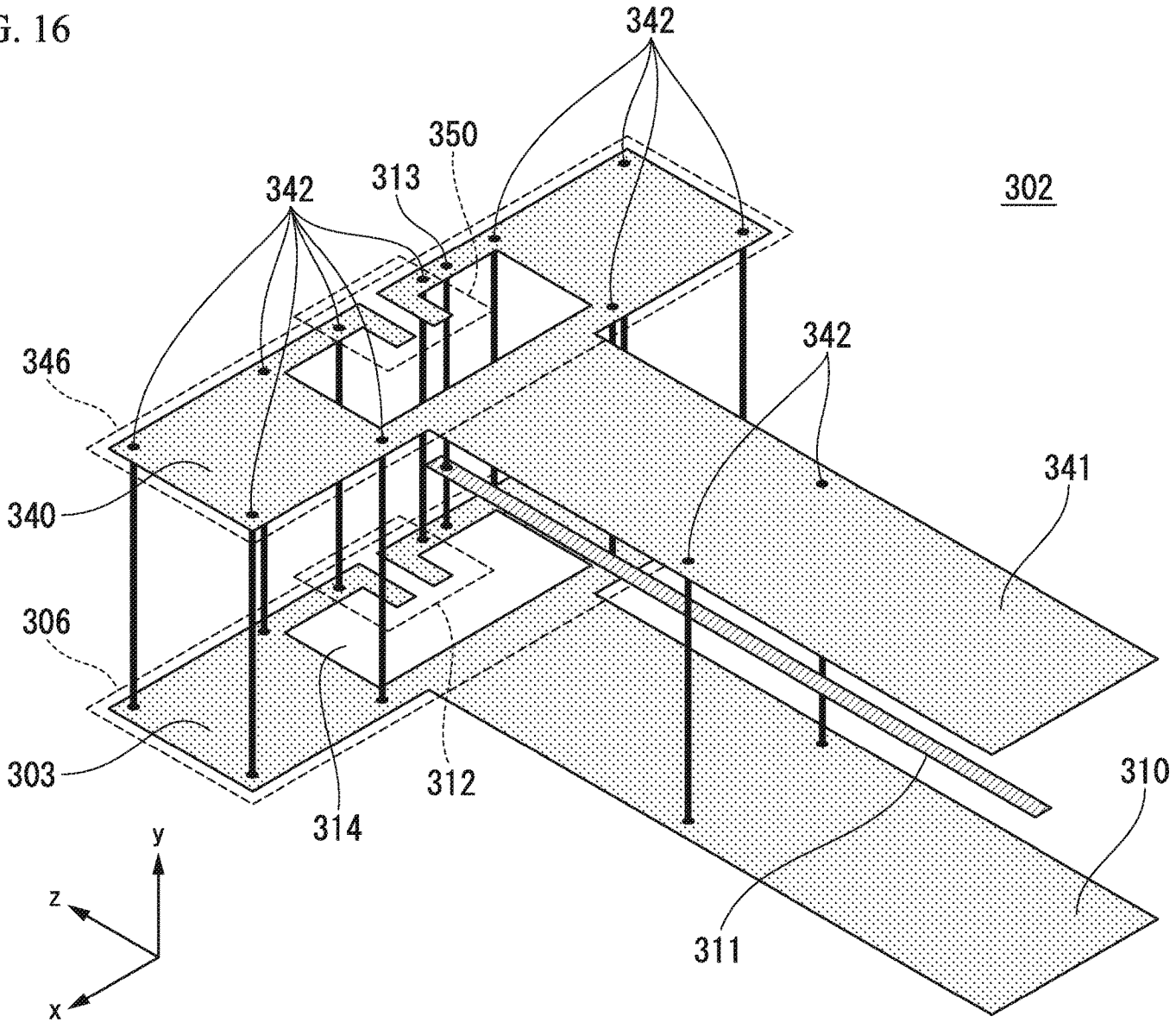
FIG. 16 is a perspective view showing an eighth variation of a radiation module disposed on a dielectric substrate in the antenna of the third embodiment.

FIG. 16 is a perspective view showing an eight variation of the radiation part 302. The radiation module 302 shown in FIG. 16 has a two-stage configuration in a y-axis direction. That is, the radiation-module resonator part 306 (i.e. a first radiation-module resonator part) includes the radiation-module ring part 303 and the radiation-module ring part 303 (i.e. a first radiation-module split part). In addition, a radiation-module resonator part 346 (i.e. a second radiation-module resonator part) includes a radiation-module ring part 340 (i.e. a second radiation-module ring part) and a radiation-module split part 350 (i.e. a second radiation-module split part). As shown in FIG. 16, it is possible to form the radiation-module resonator part 346 (i.e. the second radiation-module resonator part) and an interconnection part 341 (i.e. a second interconnection part) in a layer different from the layer of the feeder 311 and the layer for forming the radiation-module resonator part 306 (i.e. the first radiation-module resonator part) and the interconnection part 310 (i.e. a first interconnection part) disposed on the main surface of the dielectric substrate 305. The radiation-module resonator parts 306 and 346 are electrically connected together through a plurality of conductive-vias 342. The interconnection parts 310 and 341 are electrically connected together through a plurality of conductive-vias 342. In addition, the feeder 311 is interposed between the interconnection parts 310 and 341. For this reason, a pair of the radiation-module resonator parts 306 and 346 operate as a single radiation-module resonator part. Thus, the feeder 311 is shielded by a pair of the radiation-module resonator part 306 and the interconnection part 310 and a pair of the radiation-module resonator part 346 and the interconnection part 341, and therefore it is possible to suppress unwanted emission from the feeder 311 and unwanted coupling between the feeder 311 and an electromagnetic field occurring in its surrounding area.

Fourth Embodiment

Figure 17:
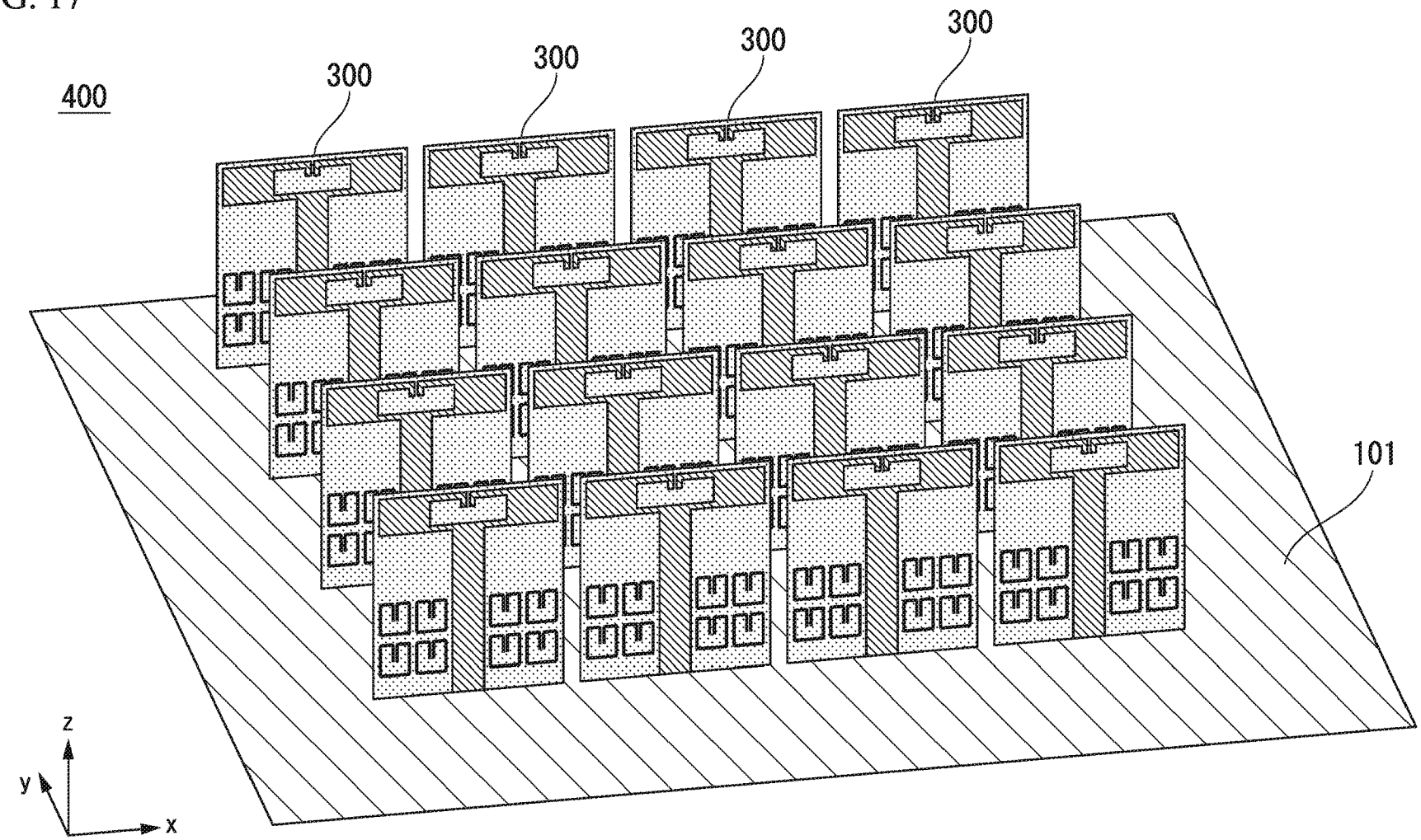
FIG. 17 is a perspective view of an antenna according to the fourth embodiment of the present invention.

Next, the antenna 400 according to the fourth embodiment of the present invention will be described below. FIG. 17 is a perspective view showing the antenna 400 according to the fourth embodiment of the present invention. The antenna 400 of the fourth embodiment includes a plurality of antennas 300 of the third embodiment. In the antenna 400, a plurality of antenna bodies are aligned along the main surfaces of the dielectric substrates 305 on the surface of the conductive reflector 101. In the antenna 400, a plurality of antenna bodies are aligned in directions crossing the main surfaces of the dielectric substrate 305 on the surface of the conductive reflector 101. Thus, a plurality of antenna bodies are aligned in an array on the antenna 400. The interconnection parts of the radiation modules 302 are electrically connected to the conductive reflector 101 while the feeders 311 are connected to a radio frequency (RF) circuit (not shown).

In the antenna 400 of the fourth embodiment, it is possible to reduce the wavelength of electromagnetic waves in the periphery of each split-ring resonator 110 (i.e. the wavelength of electromagnetic waves occurring in the area between each radiation module 302 and the conductive reflector 101) at the operating frequency of each radiation module 302. As a result, it is possible to reduce the height of the antenna 400. In this connection, it is possible to produce the conductive reflector 101 made of any conductive material irrespective of its thickness. Therefore, it is possible to reduce the thickness of the conductive reflector 101, and therefore it is possible to reduce the height of the antenna 400 counting the thickness of the conductive reflector 101.

Figure 18:
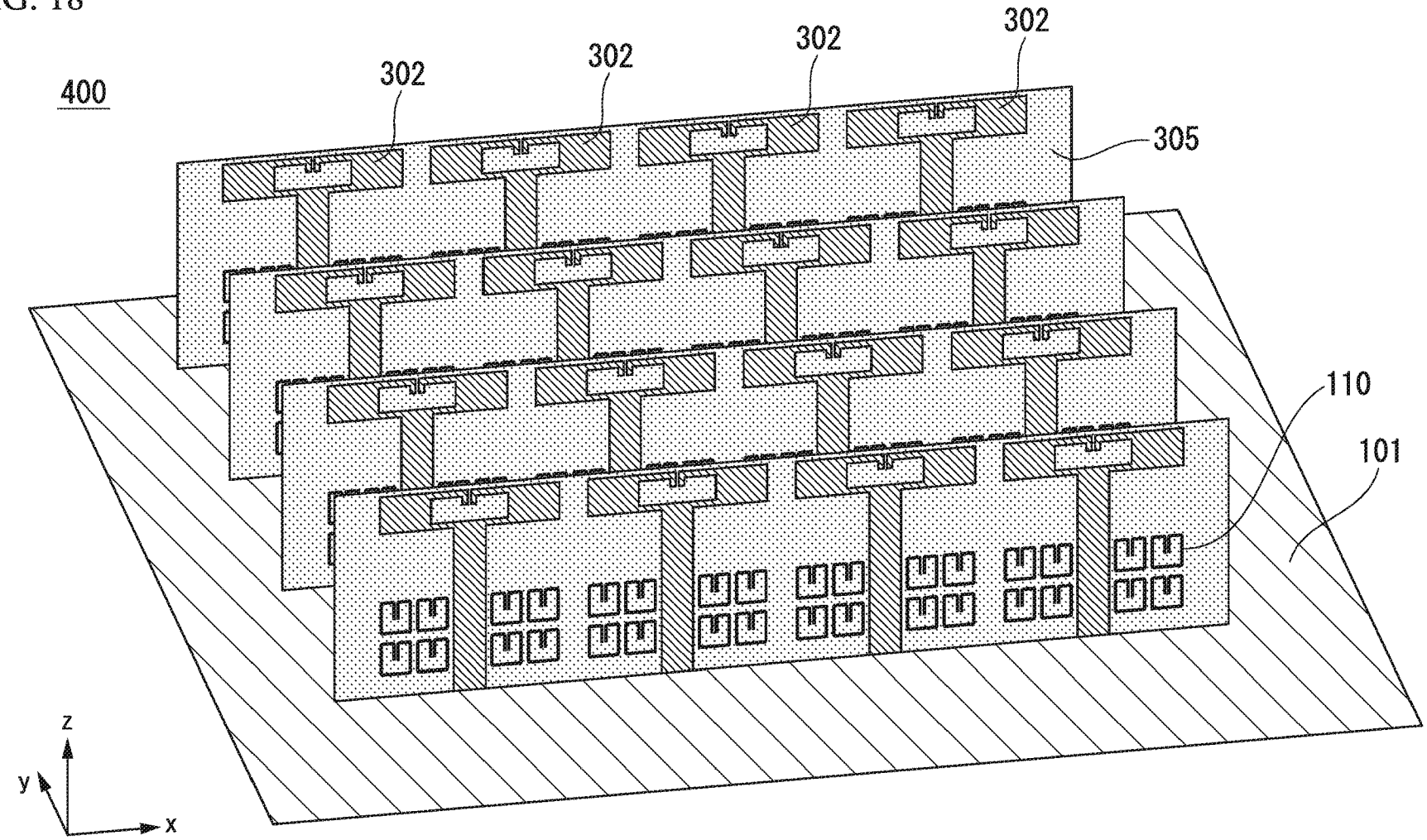
FIG. 18 is a perspective view of an antenna according to a variation of the fourth embodiment of the present invention.

In the antenna 400 of the fourth embodiment, it is possible to carry out beam forming in a desired direction by applying RF signals to the radiation modules 302 with phase differences. FIG. 18 is a perspective view showing the antenna 400 according to a variation of the fourth embodiment of the present invention. Herein, a plurality of radiation modules 302 and a plurality of split-ring resonators 110 arranged for the antennas 300 constituting the antenna 400 may be disposed on a single dielectric substrate 305 for each row in an x-axis direction. Thus, it is possible to reduce the number of steps for positioning a plurality of radiation modules 302, and therefore it is possible to easily assemble the antenna 400. In FIGS. 17 and 18, the antenna 400 includes a plurality of antennas 300 of the third embodiment aligned in an array; but this is not a restriction. For example, it is possible to align a plurality of antennas 100 of the first embodiment or a plurality of antennas 200 of the second embodiment in an array.

Figure 19:
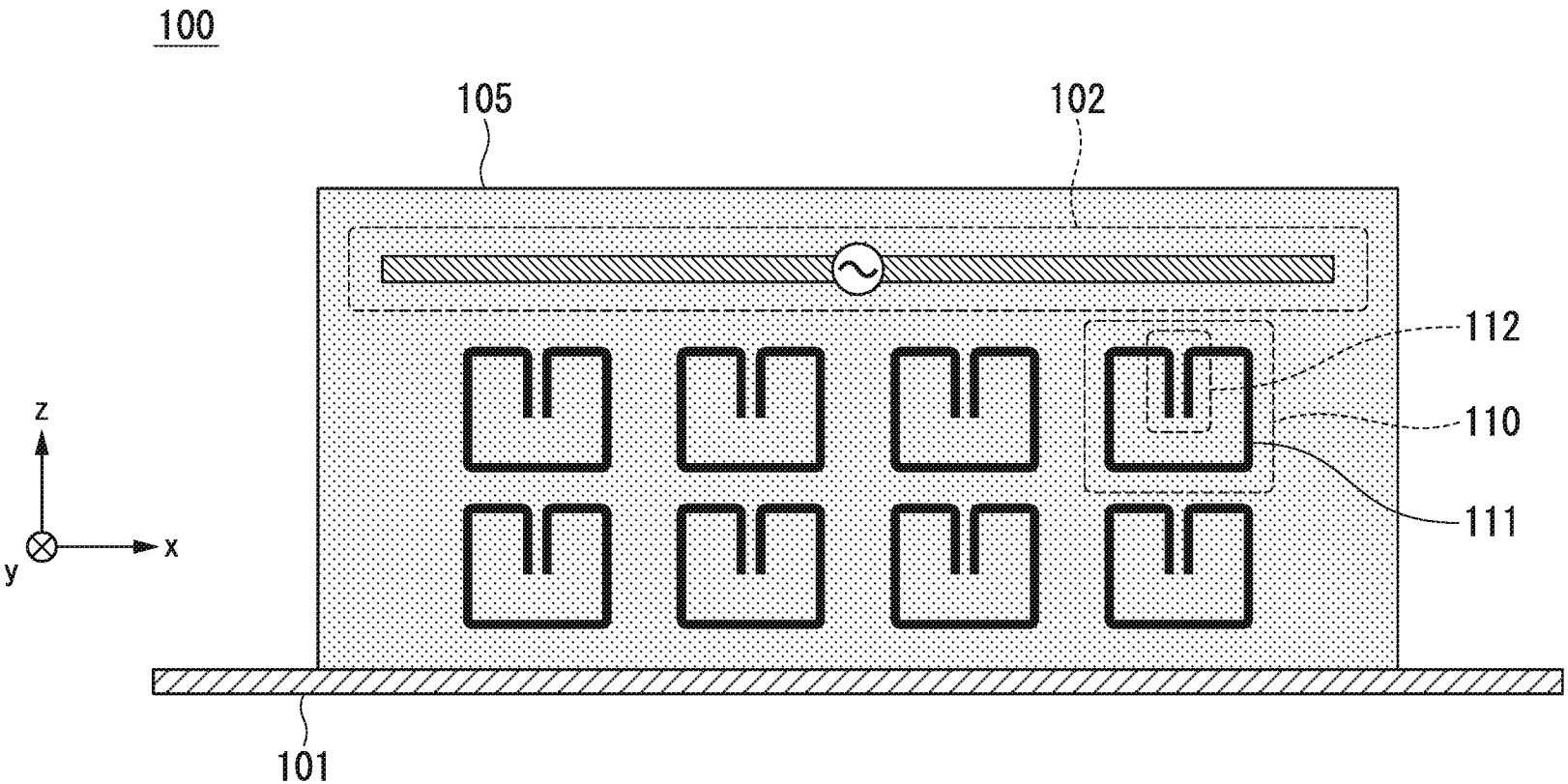
FIG. 19 is a front view showing the basic configuration of an antenna according to the present invention.

FIG. 19 is a front view showing the basic configuration of the antenna 100 according to the present invention. The antenna 100 includes at least the conductive reflector 101, the radiation module 102, the dielectric substrate 105, and a plurality of split-ring resonators 110. The radiation module 102 is disposed on the main surface 105 so as to emit radio waves. The conductive reflector 101 reflects radio waves emitted by the radiation module 102 towards the radiation module 102. A plurality of split-ring resonators 110 are disposed in a predetermined area between the radiation module 102 and the conductive reflector 101 on the main surface of the dielectric substrate 105. Each split-ring resonator 110 includes the split 112 having first and second ends disposed oppositely and separated from each other, and the ring 111 connected between the first and second ends.

The antennas according to the foregoing embodiments are adapted to wireless communication devices. Herein, the wireless communication device may include any one of antennas according to the foregoing embodiments and a communication controller configured to control communication being implemented by means of each antenna.

Lastly, the antennas according to the present invention have been described with the foregoing embodiments; but those embodiments are illustrative and not restrictive. In addition, it is possible to apply various changes and modifications in design to the foregoing embodiments within the scope of the invention not departing from the essence of the invention as defined by the appended claims; hence, the present invention may embrace any variations other than the foregoing embodiments.

INDUSTRIAL APPLICABILITY

The present invention is applied to antennas used for wireless communication devices; however, the present invention is applicable to any information devices having communication functions and other devices.

REFERENCE SIGNS LIST

100, 200, 300, 400 antenna
101 conductive reflector
102, 202, 302 radiation module
103, 203 radiating element
104, 204, 304 power supply
105, 205 dielectric substrate
110 split-ring resonator
111 ring
112 split
120, 320 auxiliary conductor
121, 313, 321, 342 conductive-via
303, 340 radiation-module ring part
306, 346 radiation-module resonator part
310, 341 interconnection part
311 feeder
312 radiation-module split part
314 opening
330 radiation part

The invention claimed is:

1. An antenna comprising:
a conductive reflector;
a dielectric substrate;
a radiation element; and
a plurality of split-ring resonators,
wherein the conductive reflector reflects waves emitted by the radiation element, the dielectric substrate is vertically disposed on the conductive reflector, the radiation element and the plurality of split-ring resonators are disposed on the main surface of the dielectric substrate, the plurality of split-ring resonators are disposed in an area between the radiation element and the conductive reflector, each of the plurality of split-ring resonators comprises a split part and a ring part, the split part comprises a first end and a second end that are separated from each other and disposed oppositely, and the first end and the second end are connected by the ring part, and wherein the radiation element comprises a radiation-module resonator part, which further comprises a radiation-module ring part with a radiation-module split part having a third end and a fourth end disposed oppositely and separated from each other, an interconnection part that is extended from the radiation-module ring part to the conductive reflector and electrically connected to the conductive reflector, and a feeder that is extended from the power supply across an internal area of the radiation-module ring part and electrically connected to the radiation-module ring part.

2. The antenna according to claim 1, wherein the feeder is disposed in an opposite side of the interconnection part of the radiation module with respect to the dielectric substrate and that is disposed at a position overlapping the interconnection part of the radiation module in view of the main surface of the dielectric substrate.

* * * * *